US011761696B2

(12) United States Patent
Morie

(10) Patent No.: US 11,761,696 B2
(45) Date of Patent: Sep. 19, 2023

(54) CRYOCOOLER, AND DIAGNOSIS DEVICE AND DIAGNOSIS METHOD OF CRYOCOOLER

(71) Applicant: SUMITOMO HEAVY INDUSTRIES, LTD., Tokyo (JP)

(72) Inventor: Takaaki Morie, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 17/720,974

(22) Filed: Apr. 14, 2022

(65) Prior Publication Data

US 2022/0235984 A1 Jul. 28, 2022

Related U.S. Application Data

(63) Continuation of application No. PCT/JP2020/037467, filed on Oct. 1, 2020.

(30) Foreign Application Priority Data

Oct. 15, 2019 (JP) ..... 2019-188402

(51) Int. Cl.
*F25B 49/00* (2006.01)
*F25B 9/06* (2006.01)

(52) U.S. Cl.
CPC ..... *F25B 49/005* (2013.01); *F25B 9/06* (2013.01); *F25B 2309/001* (2013.01);
(Continued)

(58) Field of Classification Search
CPC ..... F25B 9/06; F25B 2309/001; F01B 25/26
See application file for complete search history.

(56) References Cited

U.S. PATENT DOCUMENTS 5,010,737 A * 4/1991 Okumura ..... F25B 9/10 62/55.5
5,073,862 A * 12/1991 Carlson ..... G01M 15/09 702/185
(Continued)

FOREIGN PATENT DOCUMENTS

DE 102015011665 A1 * 3/2017
JP 2722731 B2 11/1997
(Continued)

OTHER PUBLICATIONS

English Translation DE-102015011665-A1 (Year: 2017).*
(Continued)

*Primary Examiner* — David J Teitelbaum
(74) *Attorney, Agent, or Firm* — Michael Best & Friedrich LLP

(57) ABSTRACT

A cryocooler includes a motion conversion mechanism that converts rotating motion output by a motor into linear reciprocating motion of a displacer and includes a first component and a second component slidably connected to each other, a measuring instrument that is connected to the motor to output time-series data indicating power consumption of the motor or a current flowing through the motor, and a processing unit that detects abrasion of a sliding surface between a first component and a second component of the motion conversion mechanism on the basis of section data including an intake start timing or an exhaust start timing in the time-series data.

10 Claims, 13 Drawing Sheets

(52) U.S. Cl.
CPC ..... *F25B 2500/06* (2013.01); *F25B 2500/19* (2013.01); *F25B 2700/15* (2013.01)

(56) References Cited

U.S. PATENT DOCUMENTS

| | | | | |
|---|---|---|---|---|
| 5,651,667 | A * | 7/1997 | Sand | G01L 3/00 318/432 |
| 5,900,822 | A * | 5/1999 | Sand | B01D 8/00 318/432 |
| 7,640,139 | B2 | 12/2009 | Sahara et al. | |
| 8,287,183 | B2 | 10/2012 | Shepard et al. | |
| 8,413,452 | B2 * | 4/2013 | Morris | F25B 9/10 62/51.1 |
| 9,080,453 | B2 | 7/2015 | Shepard et al. | |
| 9,691,861 | B2 | 6/2017 | Kniazev et al. | |
| 2012/0234023 | A1 | 9/2012 | Mizuno | |

FOREIGN PATENT DOCUMENTS

| | | | | |
|---|---|---|---|---|
| JP | H10305399 | A | * | 11/1998 |
| JP | 2003-279182 | A | | 10/2003 |
| JP | 2012-193926 | A | | 10/2012 |
| JP | 2013-535000 | A | | 9/2013 |
| JP | 2015-130494 | A | | 7/2015 |
| WO | 2006/043511 | A1 | | 4/2006 |
| WO | 2011/156040 | A2 | | 12/2011 |

OTHER PUBLICATIONS

English Translation JP-H10305399-A (Year: 1998).*
International Search Report issued in Application No. PCT/JP2020/037467, dated Dec. 8, 2020.

* cited by examiner

CRYOCOOLER, AND DIAGNOSIS DEVICE AND DIAGNOSIS METHOD OF CRYOCOOLER

RELATED APPLICATIONS

The contents of Japanese Patent Application No. 2019-188402, and of International Patent Application No. PCT/JP2020/037467, on the basis of each of which priority benefits are claimed in an accompanying application data sheet, are in their entirety incorporated herein by reference.

BACKGROUND

Technical Field

Certain embodiments of the present invention relate to a cryocooler, and a diagnosis device and a diagnosis method of a cryocooler.

Description of Related Art

In the related art, there is known a Gifford-McMahon (GM) cryocooler in which an expansion piston is connected to a drive motor via a crank mechanism and can reciprocate in the expansion cylinder.

SUMMARY

According to an embodiment of the present invention, there is provided a cryocooler including a motor; a displacer; a cylinder that guides linear reciprocating motion of the displacer and forms an expansion chamber for the working gas between the cylinder and the displacer; a pressure switching valve that determines an intake start timing of the working gas into the expansion chamber and an exhaust start timing of the working gas from the expansion chamber; a motion conversion mechanism that converts rotating motion output by the motor into the linear reciprocating motion of the displacer, and includes a first component and a second component slidably connected to each other; a measuring instrument that is connected to the motor to output time-series data indicating power consumption of the motor or a current flowing through the motor; and a processor configured to detect abrasion of a sliding surface between the first component and the second component of the motion conversion mechanism based on section data including the intake start timing or the exhaust start timing in the time-series data.

According to another embodiment of the present invention, there is provided a diagnosis device of a cryocooler. The cryocooler includes a motion conversion mechanism that converts rotating motion output by a motor into linear reciprocating motion of a displacer and includes a first component and a second component slidably connected to each other. The diagnosis device includes a measuring instrument that is connected to the motor to output time-series data indicating power consumption of the motor or a current flowing through the motor; and a processor configured to detect abrasion of a sliding surface between the first component and the second component of the motion conversion mechanism based on section data including an intake start timing of a working gas into an expansion chamber of the cryocooler or an exhaust start timing of the working gas from the expansion chamber in the time-series data.

According to still another embodiment of the present invention, there is provided a diagnosis method of a cryocooler. The cryocooler includes a motion conversion mechanism that converts rotating motion output by a motor into linear reciprocating motion of a displacer and includes a first component and a second component slidably connected to each other. The method includes acquiring time-series data indicating power consumption of the motor or a current flowing through the motor; and detecting abrasion of a sliding surface between the first component and the second component of the motion conversion mechanism based on section data including an intake start timing of a working gas into an expansion chamber of the cryocooler or an exhaust start timing of the working gas from the expansion chamber in the time-series data.

DETAILED DESCRIPTION

The present inventor has studied a cryocooler having a built-in motion conversion mechanism, such as a GM cryocooler, and has come to recognize the following fact. In such a cryocooler, as an operation is continued for a long period of time, abrasion of movable components of the motion conversion mechanism may progress, and thus a gap between the components may gradually expand. Consequently, abnormal noise may be generated from the motion conversion mechanism during operation of the cryocooler. This abnormal noise is collision noise between components generated due to backlash between components. As the abrasion progresses, the gap between the components becomes larger, and abnormal noise may become noticeable. This is not desirable as it is often perceived as unpleasant noise by cryocooler users. When the abrasion further progresses, the components will eventually need to be replaced.

A cumulative operation time of a cryocooler may be an indicator of the degree of abrasion. For example, abrasion is considered to have occurred after a certain operation time. However, in reality, the progress of abrasion is greatly affected by individual circumstances such as individual differences between cryocoolers and how individual users use the cryocoolers. Thus, a length of the operation time and the degree of abrasion cannot be immediately associated with each other, and it is difficult to accurately identify the progress of abrasion of the components of the motion conversion mechanism from the cumulative operation time.

After all, there has been no effective way to automatically detect the abrasion of the motion conversion mechanism built into the cryocooler.

It is desirable to provide a diagnosis technique for detecting abrasion of a motion conversion mechanism of a cryocooler.

Any combination of the components described above and a combination obtained by replacing the components and expressions of the present invention between methods, devices, and systems are also effective as an embodiment of the present invention.

According to the present invention, it is possible to provide a diagnosis technique for detecting abrasion of a motion conversion mechanism of a cryocooler.

Hereinafter, an embodiment for carrying out the present invention will be described in detail with reference to the drawings. In the description and drawings, the same or equivalent components, members, and processing will be assigned with the same reference symbols, and redundant description thereof will be omitted as appropriate. The scales and shapes of shown components are set for convenience in order to make the description easy to understand, and are not to be understood as limiting unless stated otherwise. The embodiment is merely an example and does not limit the scope of the present invention. All characteristics and combinations to be described in the embodiment are not necessarily essential to the invention.

Figure 1:
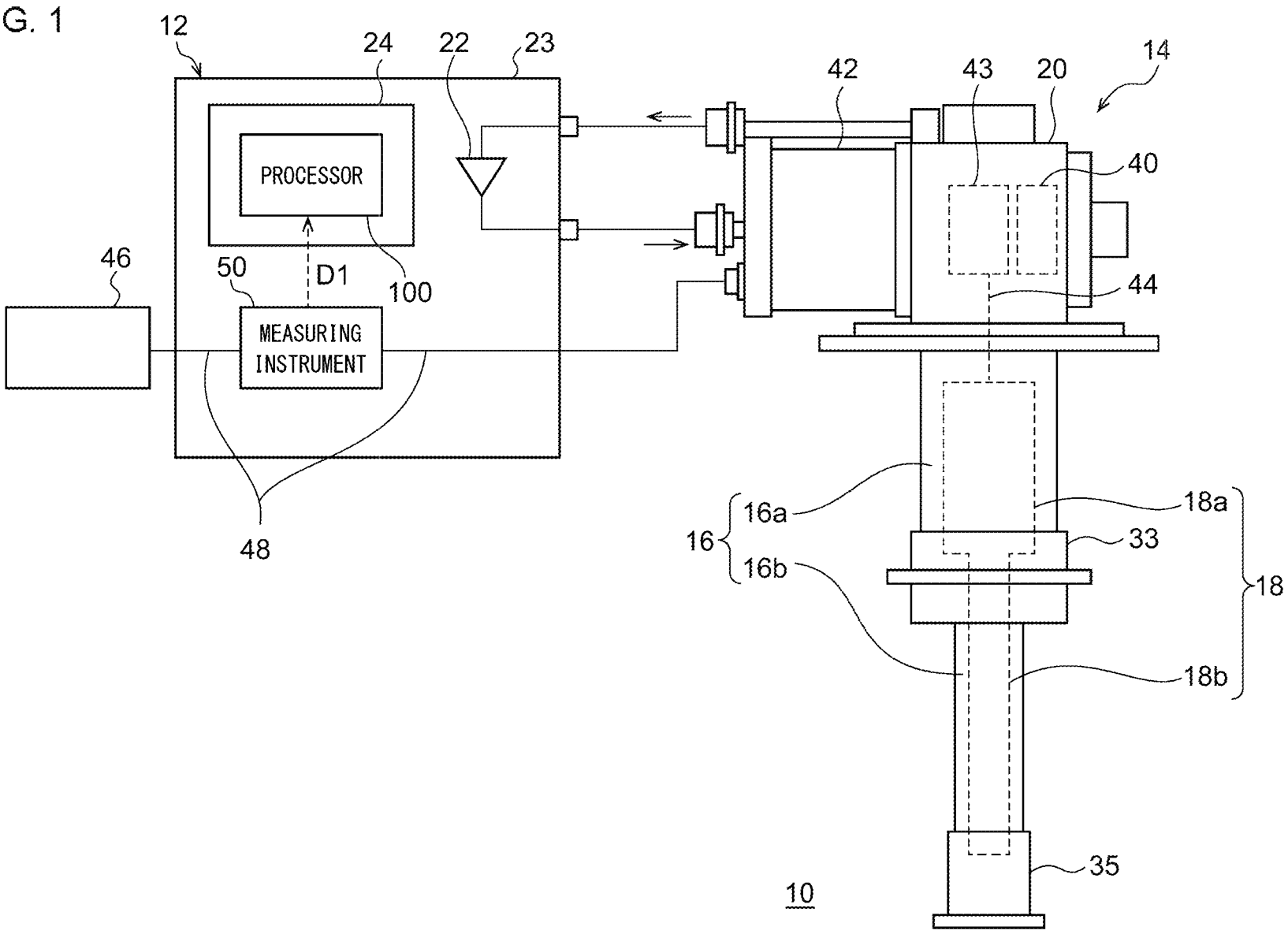
FIG. 1 is a view schematically showing a cryocooler according to an embodiment.
Figure 2:
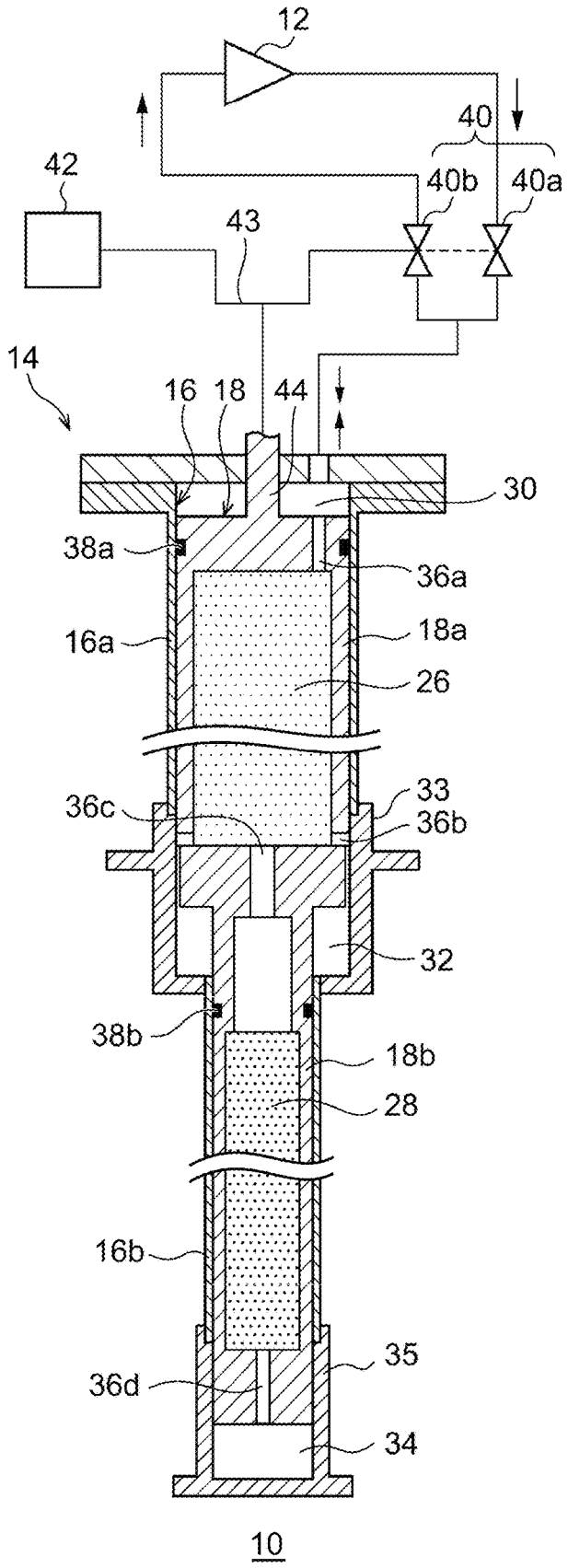
FIG. 2 is a view schematically showing the cryocooler according to the embodiment.
Figure 3:
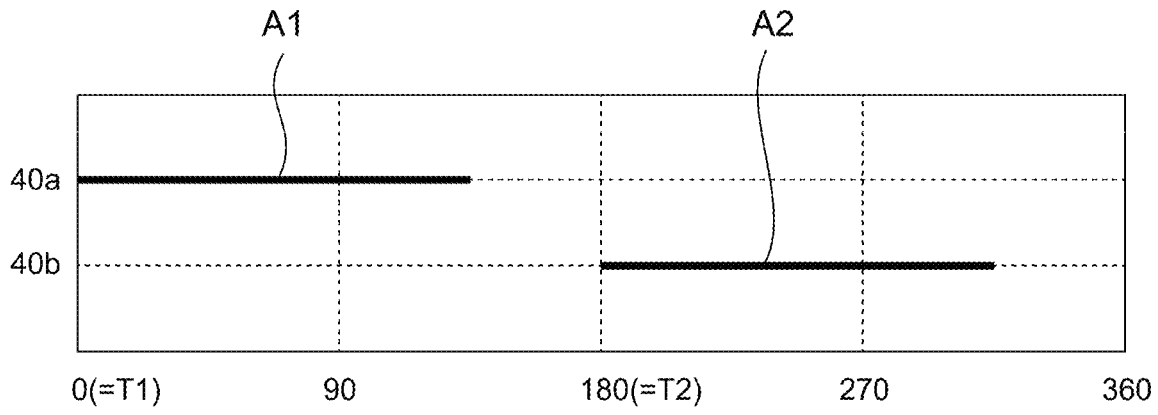
FIG. 3 is a view showing an exemplary valve timing used in the cryocooler according to the embodiment.

FIGS. 1 and 2 are views schematically showing a cryocooler 10 according to an embodiment. FIG. 3 is a diagram showing an exemplary valve timing used in the cryocooler 10 according to the embodiment. FIG. 1 shows an appearance of the cryocooler 10, and FIG. 2 shows an internal structure of the cryocooler 10. The cryocooler 10 is, for example, a two-stage type Gifford-McMahon (GM) cryocooler.

The cryocooler 10 includes a compressor 12 and an expander 14. The compressor 12 includes a measuring instrument 50 and a processing unit or a processor 100. The expander 14 includes a motor 42 and a motion conversion mechanism 43. Although the details will be described later, a diagnosis device of the motion conversion mechanism 43 is configured with the motor 42, the measuring instrument 50, and the processing unit 100.

The compressor 12 is configured to collect a working gas of the cryocooler 10 from the expander 14, to pressurize the collected working gas, and to supply the working gas to the expander 14 again. The working gas is also called a refrigerant gas, and other suitable gases may be used although a helium gas is typically used.

In general, both of the pressure of a working gas supplied from the compressor 12 to the expander 14 and the pressure of a working gas collected from the expander 14 to the compressor 12 are considerably higher than the atmospheric pressure, and can also be called a first high pressure and a second high pressure, respectively. For convenience of description, the first high pressure and the second high pressure are simply called a high pressure and a low pressure, respectively. Typically, the high pressure is, for example, 2 to 3 MPa. The low pressure is, for example, 0.5 to 1.5 MPa, and is, for example, about 0.8 MPa. For better understanding, a direction in which the working gas flows is shown with arrows.

The compressor 12 includes a compressor main body 22 and a compressor casing 23 that houses the compressor main body 22. The compressor 12 will also be referred to as a compressor unit.

The compressor main body 22 is configured to internally compress the working gas sucked from a suction port and to discharge the working gas from a discharge port. The compressor main body 22 may be, for example, a scroll type pump, a rotary type pump, or other pumps that pressurize the working gas. In the embodiment, the compressor main body 22 is configured to discharge the working gas at a fixed and constant flow rate. Alternatively, the compressor main body 22 may be configured to change the flow rate of the working gas to be discharged. The compressor main body 22 will be referred to as a compression capsule in some cases.

The compressor 12 may include a compressor controller 24 that controls the compressor 12. The compressor controller 24 may not only control the compressor 12 but also control the cryocooler 10 in an integrated manner, and may also control, for example, the expander 14 (for example, the motor 42). The compressor controller 24 may be attached to the compressor 12, and may be installed on, for example, an outer surface of the compressor casing 23 and housed in the compressor casing 23. Alternatively, the compressor controller 24 may be disposed away from the compressor 12 and connected to the compressor 12 via, for example, a control signal line.

The expander 14 includes a cryocooler cylinder 16 and a displacer assembly 18. The cryocooler cylinder 16 guides linear reciprocating motion of the displacer assembly 18 and forms expansion chambers (32 and 34) for the working gas with the displacer assembly 18. The expander 14 includes a pressure switching valve 40 that determines an intake start timing of the working gas into the expansion chamber and an exhaust start timing of the working gas from the expansion chamber.

In the present specification, in order to describe a positional relationship between components of the cryocooler 10, for convenience of description, a side close to a top dead center of axial reciprocation of a displacer will be referred to as "up" and a side close to a bottom dead center will be referred to as "down". The top dead center is the position of the displacer at which the volume of an expansion space is maximum, and the bottom dead center is the position of the displacer at which the volume of the expansion space is minimum. Since a temperature gradient in which the temperature drops from an upper side to a lower side in an axial direction is generated during the operation of the cryocooler 10, the upper side can also be called a high temperature side and the lower side can also be called a low temperature side.

The cryocooler cylinder 16 includes a first cylinder 16*a* and a second cylinder 16*b*. The first cylinder 16*a* and the second cylinder 16*b* each are, for example, a member that has a cylindrical shape, and the second cylinder 16*b* has a diameter smaller than that of the first cylinder 16*a*. The first cylinder 16*a* and the second cylinder 16*b* are coaxially disposed, and a lower end of the first cylinder 16*a* is strongly connected to an upper end of the second cylinder 16*b*.

The displacer assembly 18 includes a first displacer 18*a* and a second displacer 18*b* that are connected to each other, and the displacers move integrally. The first displacer 18*a* and the second displacer 18*b* each are, for example, a member that has a cylindrical shape, and the second displacer 18*b* has a diameter smaller than that of the first displacer 18*a*. The first displacer 18*a* and the second displacer 18*b* are coaxially disposed.

The first displacer 18*a* is accommodated in the first cylinder 16*a*, and the second displacer 18*b* is accommodated in the second cylinder 16*b*. The first displacer 18*a* can reciprocate in the axial direction along the first cylinder 16*a*, and the second displacer 18*b* can reciprocate in the axial direction along the second cylinder 16*b*.

As shown in FIG. 2, the first displacer 18*a* accommodates a first regenerator 26. The first regenerator 26 is formed by filling a tubular main body portion of the first displacer 18*a* with, for example, a wire mesh made of, such as copper, or other appropriate first regenerator material. An upper lid portion and a lower lid portion of the first displacer 18*a* may be provided as members separate from the main body portion of the first displacer 18*a*, or the first regenerator material may be accommodated in the first displacer 18*a* by fixing the upper lid portion and the lower lid portion of the first displacer 18*a* to the main body through appropriate means such as fastening and welding.

Similarly, the second displacer 18*b* accommodates a second regenerator 28. The second regenerator 28 is formed by filling a tubular main body portion of the second displacer 18*b* with, for example, a non-magnetic regenerator material such as bismuth, a magnetic regenerator material such as $HoCu_2$, or other appropriate second regenerator material. The second regenerator material may be molded into a granular shape. An upper lid portion and a lower lid portion of the second displacer 18*b* may be provided as members separate from the main body portion of the second displacer 18*b*, or the second regenerator material may be accommodated in the second displacer 18*b* by fixing the upper lid portion and the lower lid portion of the second displacer 18*b* to the main body through appropriate means such as fastening and welding.

The displacer assembly 18 forms, inside the cryocooler cylinder 16, a room temperature chamber 30, a first expansion chamber 32, and a second expansion chamber 34. In order to exchange heat with a desired object or medium to be cooled by the cryocooler 10, the expander 14 includes a first cooling stage 33 and a second cooling stage 35. The room temperature chamber 30 is formed between the upper lid portion of the first displacer 18*a* and an upper portion of the first cylinder 16*a*. The first expansion chamber 32 is formed between the lower lid portion of the first displacer 18*a* and the first cooling stage 33. The second expansion chamber 34 is formed between the lower lid portion of the second displacer 18*b* and the second cooling stage 35. The first cooling stage 33 is fixed to a lower portion of the first cylinder 16*a* to surround the first expansion chamber 32, and the second cooling stage 35 is fixed to a lower portion of the second cylinder 16*b* to surround the second expansion chamber 34.

The first regenerator 26 is connected to the room temperature chamber 30 through a working gas flow path 36*a* formed in the upper lid portion of the first displacer 18*a*, and is connected to the first expansion chamber 32 through a working gas flow path 36*b* formed in the lower lid portion of the first displacer 18*a*. The second regenerator 28 is connected to the first regenerator 26 through a working gas flow path 36*c* formed from the lower lid portion of the first displacer 18*a* to the upper lid portion of the second displacer 18*b*. In addition, the second regenerator 28 is connected to the second expansion chamber 34 through a working gas flow path 36*d* formed in the lower lid portion of the second displacer 18*b*.

In order to introduce working gas flow between the first expansion chamber 32, the second expansion chamber 34, and the room temperature chamber 30 to the first regenerator 26 and the second regenerator 28 instead of a clearance between the cryocooler cylinder 16 and the displacer assembly 18, a first seal 38*a* and a second seal 38*b* may be provided. The first seal 38*a* may be mounted on the upper lid portion of the first displacer 18*a* to be disposed between the first displacer 18*a* and the first cylinder 16*a*. The second seal 38*b* may be mounted on the upper lid portion of the second displacer 18*b* to be disposed between the second displacer 18*b* and the second cylinder 16*b*.

As shown in FIG. 1, the expander 14 includes a cryocooler housing 20 that accommodates the pressure switching valve 40. The cryocooler housing 20 is coupled to the cryocooler cylinder 16, and accordingly a hermetic container that accommodates the pressure switching valve 40 and the displacer assembly 18 is configured.

As shown in FIG. 2, the pressure switching valve 40 is configured to include a high pressure valve 40*a* and a low pressure valve 40*b* and to generate periodic pressure fluctuations in the cryocooler cylinder 16. A working gas discharge port of the compressor 12 is connected to the room temperature chamber 30 via the high pressure valve 40*a*, and a working gas suction port of the compressor 12 is connected to the room temperature chamber 30 via the low pressure valve 40*b*. The high pressure valve 40*a* and the low pressure valve 40*b* are configured to open and close selectively and alternately (that is, such that when one is open, the other is closed).

FIG. 3 shows a valve timing of the pressure switching valve 40. One rotation of the pressure switching valve 40, that is, one refrigeration cycle of the cryocooler 10, includes an intake step A1 and an exhaust step A2. Since one refrigeration cycle is shown in association with 360 degrees, 0 degrees corresponds to the start time of the cycle and 360 degrees corresponds to the end time of the cycle. 90 degrees, 180 degrees, and 270 degrees correspond to ¼ cycle, half cycle, and ¾ cycle, respectively. Here, for convenience, as an example without limitation, the start of the intake step A1 is set to 0 degrees, and the start of the exhaust step A2 is set to 180 degrees.

The high pressure valve 40*a* sets an intake start timing T1. That is, the intake step A1 is started when the high pressure valve 40*a* is opened. In the intake step A1, the low pressure valve 40*b* is closed. A high pressure working gas flows from the compressor 12 into the room temperature chamber 30 through the high pressure valve 40*a*, is supplied to the first expansion chamber 32 through the first regenerator 26, and is supplied to the second expansion chamber 34 through the second regenerator 28. The pressures in the first expansion chamber 32 and the second expansion chamber 34 rapidly increase at the intake start timing T1. When the high pressure valve 40*a* is closed, the intake step A1 ends. The first expansion chamber 32 and the second expansion chamber 34 are maintained at a high pressure.

The low pressure valve 40*b* sets an exhaust start timing T2. That is, an exhaust step A2 is started when the low pressure valve 40*b* is opened. In the exhaust step A2, the high pressure valve 40*a* is closed. Since the high pressure first expansion chamber 32 and the high pressure second expansion chamber 34 are opened to the low pressure working gas suction port of the compressor 12 at the exhaust start timing T2, the working gas is expanded in the first expansion chamber 32 and the second expansion chamber 34, and the working gas which has a low pressure as a result is discharged from the first expansion chamber 32 and the second expansion chamber 34 to the room temperature chamber 30 through the first regenerator 26 and the second regenerator 28. The pressures in the first expansion chamber 32 and the second expansion chamber 34 rapidly decrease at the exhaust start timing T2. The working gas is collected from the expander 14 to the compressor 12 through the low pressure valve 40*b*. When the low pressure valve 40*b* is closed, the exhaust step A2 ends. The first expansion chamber 32 and the second expansion chamber 34 are maintained at a low pressure.

As shown in FIG. 3, there may be a period in which both the high pressure valve 40*a* and the low pressure valve 40*b* are closed from the end of the intake step A1 to the start of the exhaust step A2. There may be a period in which both the high pressure valve 40*a* and the low pressure valve 40*b* are closed from the end of the exhaust step A2 to the start of the intake step A1.

The pressure switching valve 40 may take a form of a rotary valve. That is, the pressure switching valve 40 may be configured such that the high pressure valve 40*a* and the low pressure valve 40*b* are alternately opened and closed by rotational sliding of a valve disk with respect to a stationary valve main body. In this case, the motor 42 may be connected to the pressure switching valve 40 to rotate the valve disk of the pressure switching valve 40. For example, the pressure switching valve 40 is disposed such that a valve rotation axis is coaxial with a rotation axis of the motor 42.

Alternatively, the high pressure valve 40*a* and the low pressure valve 40*b* each may be a valve that can be individually controlled, and in this case, the pressure switching valve 40 may not be connected to the motor 42.

FIGS. 1 and 2 will be referred to again. The motor 42 is attached to the cryocooler housing 20. The motion conversion mechanism 43 is accommodated in the cryocooler housing 20 like the pressure switching valve 40.

For example, the motor 42 is connected to a displacer drive shaft 44 via a motion conversion mechanism 43 such as a scotch yoke mechanism. The motion conversion mechanism 43 converts rotating motion output by the motor 42 into linear reciprocating motion of the displacer drive shaft 44. The displacer drive shaft 44 extends from the motion conversion mechanism 43 into the room temperature chamber 30, and is fixed to the upper lid portion of the first displacer 18*a*. The rotation of the motor 42 is converted into the axial reciprocation of the displacer drive shaft 44 by the motion conversion mechanism 43, and the displacer assembly 18 linearly reciprocates in the axial direction in the cryocooler cylinder 16.

Incidentally, the cryocooler 10 is supplied with power from a power source 46 such as a commercial power source (three-phase alternating current power source). The power source 46 is connected to the compressor 12 and the motor 42 via a power supply wiring 48. Since the motor 42 is connected to the power source 46 via the compressor 12, the compressor 12 may also be regarded as a power source of the motor 42. The compressor 12 and the motor 42 may be connected to individual power sources.

The motor 42 is, for example, a three-phase motor. The motor 42 operates at a constant rotation speed based on the frequency of the power source 46.

The measuring instrument 50 is connected to the motor 42 such that time-series data D1 indicating power consumption of the motor 42 or a current flowing through the motor 42 is output. Therefore, the time-series data D1 indicates a time change of the power consumption of the motor 42 or the current flowing through the motor 42 during the operation of the cryocooler 10. The measuring instrument 50 is installed at the power supply wiring 48 in order to acquire the time-series data D1.

As an exemplary configuration, the measuring instrument 50 may employ, for example, a three-phase wattmeter based on the two-power metering method, or may be another type of power sensor that measures the power consumption of the motor 42. Alternatively, the measuring instrument 50 may be a three-phase ammeter that simultaneously measures three-phase currents flowing through the motor 42 individually, or may be another type of current sensor that measures a current flowing through the motor 42.

The measuring instrument 50 outputs the time-series data D1 to the processing unit 100. The measuring instrument 50 is communicatively connected to the processing unit 100 by wire or wirelessly. In the illustrated example, the measuring instrument 50 is built in the compressor 12, but the present embodiment is not limited to this. The measuring instrument 50 may be provided in the expander 14, such as mounted on the motor 42, or may be provided in another location on the power supply wiring 48.

The processing unit 100 is configured to receive the time-series data D1 from the measuring instrument 50 and diagnose the motion conversion mechanism 43 on the basis of the time-series data D1. The processing unit 100 is mounted on the compressor 12 and configures a part of the compressor controller 24, but the present embodiment is not limited to this. The processing unit 100 may be disposed away from the compressor 12, and in that case, may be connected to the measuring instrument 50 via a signal wiring. The processing unit 100 may be mounted on the expander 14. However, the processing unit 100 is disposed in a room temperature environment such as the cryocooler housing 20. Details of the processing unit 100 will be described later.

When the compressor 12 and the motor 42 are operated, the cryocooler 10 causes periodic volume fluctuations in the first expansion chamber 32 and the second expansion chamber 34 and pressure fluctuations of the working gas in synchronization therewith. Typically, the displacer assembly 18 is moved up from the bottom dead center to the top dead center in the intake step A1 to increase the volumes of the first expansion chamber 32 and the second expansion chamber 34, and the displacer assembly 18 is moved down in the exhaust step A2 from the top dead center to the bottom dead center to reduce the volumes of the first expansion chamber 32 and the second expansion chamber 34.

As described above, for example, a refrigeration cycle such as a GM cycle is provided, and the first cooling stage 33 and the second cooling stage 35 are cooled to a desired cryogenic temperature. The first cooling stage 33 may be cooled to a first cooling temperature within a range of, for example, about 20 K to about 40 K. The second cooling stage 35 may be cooled to a second cooling temperature (for example, about 1 K to about 4 K) lower than the first cooling temperature.

Figure 4A:
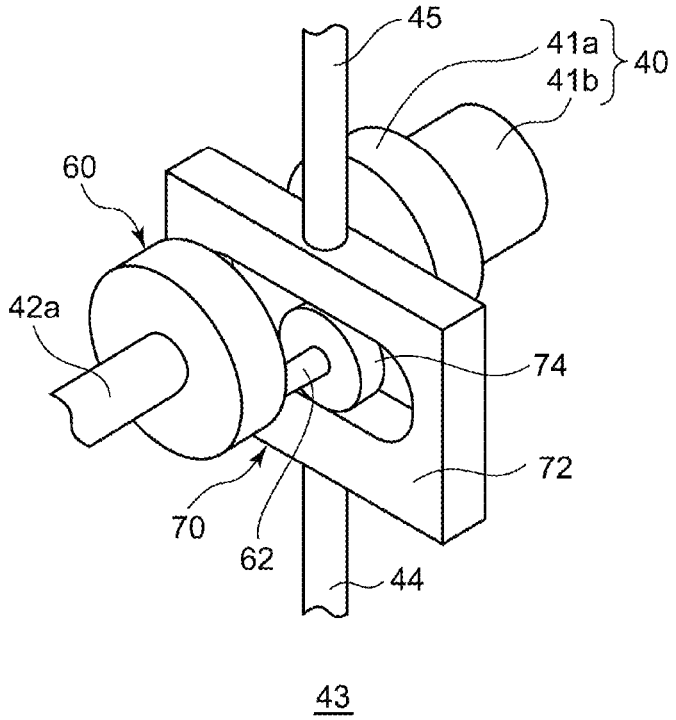
FIG. 4A is a schematic perspective view showing an exemplary motion conversion mechanism.
Figure 4B:
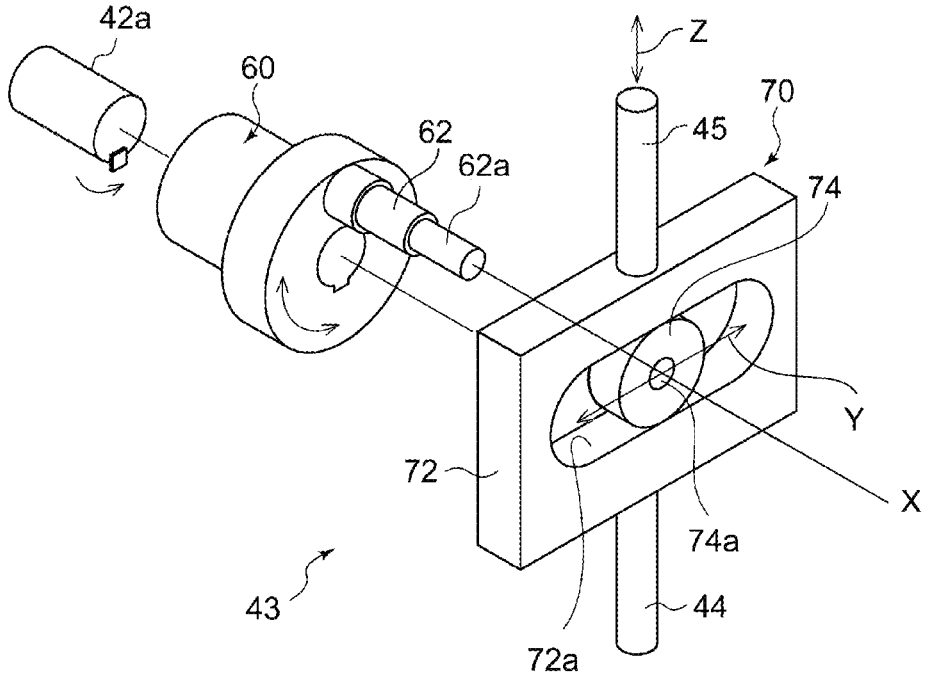
FIG. 4B is an exploded perspective view schematically showing the motion conversion mechanism in FIG. 4A.

FIG. 4A is a schematic perspective view showing an exemplary motion conversion mechanism 43. FIG. 4B is an exploded perspective view schematically showing the motion conversion mechanism 43 in FIG. 4A. The shown motion conversion mechanism 43 is configured as a scotch yoke mechanism. The motion conversion mechanism 43 includes a crank 60 and a scotch yoke 70. The crank 60 is fixed to a rotary shaft 42*a* of the motor 42. The scotch yoke 70 is disposed on a side opposite to the rotary shaft 42*a* of the motor 42 with respect to the crank 60. The crank 60 has a connecting shaft 62 eccentrically connected to the rotary shaft 42*a*. The connecting shaft 62 extends from the crank 60 toward the scotch yoke 70 in parallel to the rotary shaft 42*a*. The rotary shaft 42*a* and the connecting shaft 62 extend along an axis X.

The scotch yoke 70 includes a yoke plate 72 and a rolling element (hereinafter, also referred to as a rolling bush) 74, and is movable in an axial direction (indicated by an arrow Z) orthogonal to the axis X. An upper shaft 45 and a displacer drive shaft 44 are fixed to the yoke plate 72. The upper shaft 45 extends upward from the center of an upper frame of the yoke plate 72, and the displacer drive shaft 44 extends downward from the center of a lower frame of the yoke plate 72. The upper shaft 45 and the displacer drive shaft 44 each are supported by the cryocooler housing 20 (refer to FIG. 1) so as to be slidable in the axial direction.

The yoke plate 72 has a laterally elongated yoke window 72*a* (indicated by an arrow Y) orthogonal to the axis X and the axial direction Z. The rolling bush 74 is disposed in the yoke window 72*a*. The rolling bush 74 has a shaft hole 74*a* at the center, and the connecting shaft 62 penetrates through the shaft hole 74*a*. The connecting shaft 62 is in sliding contact with the rolling bush 74 through the shaft hole 74*a*, and the connecting shaft 62 and the rolling bush 74 are slidably connected to each other through the shaft hole 74*a*. The rolling bush 74 acts as a non-lubricated sliding bearing that supports the connecting shaft 62. The rolling bush 74 is in rolling contact with the yoke plate 72 at the yoke window 72*a*, and the rolling bush 74 is rolled and slidably connected to the yoke plate 72 at the yoke window 72*a*.

When the rotary shaft 42*a* rotates due to the drive of the motor 42, the crank 60 rotates together with the rotary shaft 42*a*, and the connecting shaft 62 and the rolling bush 74 connected to the connecting shaft 62 rotate in a circle around the rotary shaft 42*a*. In this case, the connecting shaft 62 slides while rotating with respect to the rolling bush 74 in the shaft hole 74*a*. The rolling bush 74 reciprocates in the lateral direction Y while rolling in the yoke window 72*a*, and reciprocates in the axial direction Z together with the yoke plate 72. The axial reciprocation of the yoke plate 72 causes the displacer drive shaft 44 and the displacer assembly 18 to reciprocate in the axial direction. As described above, the rotating motion output by the motor 42 is converted into the linear reciprocating motion of the displacer.

The connecting shaft 62 may further extend through the shaft hole 74*a*. In a case where the pressure switching valve 40 is configured as a rotary valve, a tip 62*a* of the connecting shaft 62 is connected to a valve disk 41*a* of the pressure switching valve 40, and the valve disk 41*a* rotates with respect to a stationary valve main body 41*b* due to rotation of the crank 60. Therefore, the pressure switching valve 40 can rotate in synchronization with the motion conversion mechanism 43.

Figure 5A:
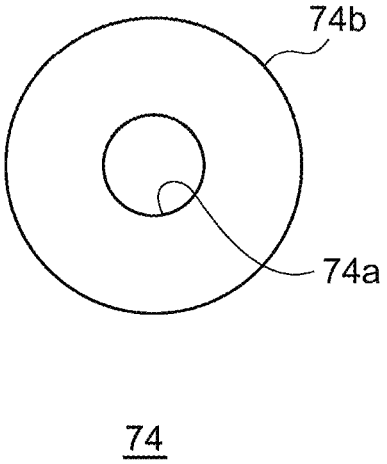
FIGS. 5A and 5B are schematic views showing a rolling bush.
Figure 5B:
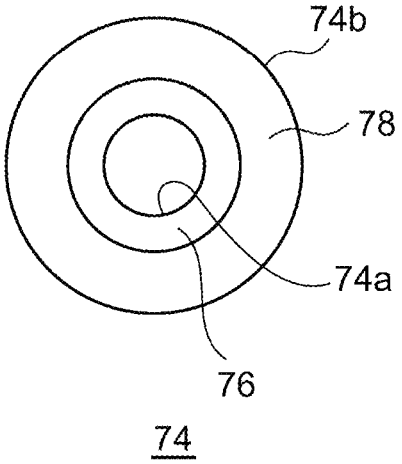

FIGS. 5A and 5B are schematic views showing the rolling bush 74. As shown in FIG. 5A, the rolling bush 74 is a disk-shaped member having the circular shaft hole 74*a*. As described above, since the shaft hole 74*a* is a sliding surface on which the connecting shaft 62 slides, the rolling bush 74 is made of a resin material having excellent abrasion resistance, such as fluororesin. In this case, an outer peripheral surface 74*b* of the rolling bush 74, which is a rolling sliding surface with respect to the yoke plate 72, is also made of an abrasion-resistant material. The abrasion-resistant rolling bush 74 can be provided.

As shown in FIG. 5B, the rolling bush 74 may include a bush inner ring 76 having the circular shaft hole 74*a* and a bush outer ring 78 having the outer peripheral surface 74*b*. The bush inner ring 76 and the bush outer ring 78 are coaxially disposition, and the bush inner ring 76 is fixed to the bush outer ring 78. The bush inner ring 76 is made of a resin material having excellent abrasion resistance, such as fluororesin. The bush outer ring 78 is made of a material different from that of the bush inner ring 76, such as a general-purpose resin material. Since the abrasion-resistant material is relatively expensive, the rolling bush 74 can be made inexpensive by using the abrasion-resistant material for only a part of the rolling bush 74.

Figure 6A:
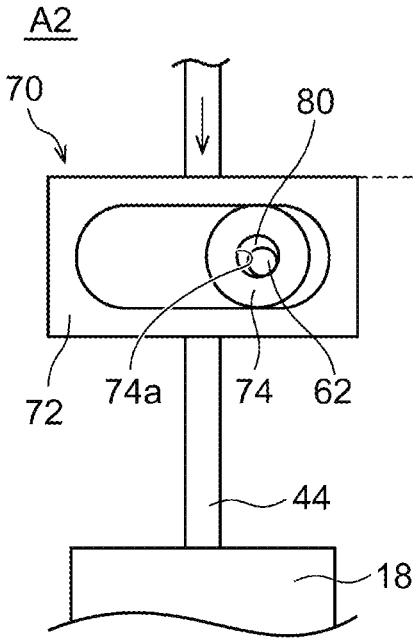
FIGS. 6A and 6B are schematic views showing an operation of a motion conversion mechanism in a cryocooler.
Figure 6B:
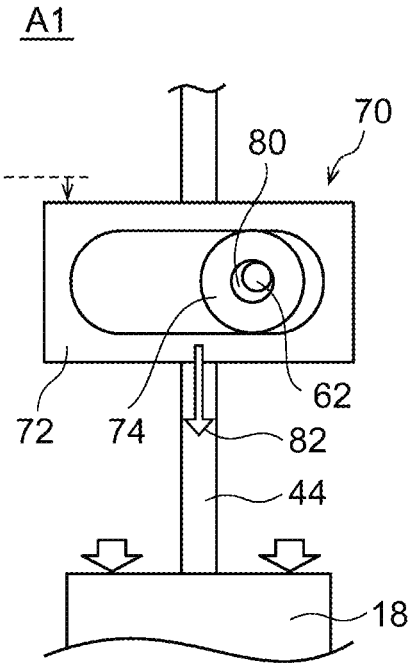

FIGS. 6A and 6B are schematic views showing an operation of the motion conversion mechanism 43 in the cryocooler 10. In the newly manufactured cryocooler 10, components of the motion conversion mechanism 43 are combined with each other with design tolerances, and there is no unnecessary backlash between the components. However, as the cryocooler 10 is operated for a long period of time, abrasion of the movable components of the motion conversion mechanism 43 progresses. The sliding surface between the components is prone to abrasion, and, thus, for example, the shaft hole 74*a* of the rolling bush 74 gradually expands such that a gap 80 is generated between the rolling bush 74 and the connecting shaft 62.

FIG. 6A shows that the scotch yoke 70 is approaching the bottom dead center at the end of the exhaust step A2. Since the connecting shaft 62 is rotating and pushing the rolling bush 74 and the yoke plate 72 downward, the gap 80 is above the connecting shaft 62 in the shaft hole 74*a*. In this case, the first expansion chamber 32 and the second expansion chamber 34 of the expander 14 are filled with the low pressure working gas.

Assuming that the intake start timing T1 arrives immediately after this and the intake step A1 starts, the high pressure working gas flows from the high pressure valve 40*a* into the room temperature chamber 30 as described above. Until the inflowing gas flows into the first expansion chamber 32 and the second expansion chamber 34, the differential pressure between the room temperature chamber 30 and these expansion chambers acts downward on the displacer assembly 18. The scotch yoke 70 is fixed to the displacer assembly 18.

Thus, at the intake start timing T1, as shown in FIG. 6B, a downward force 82 transiently acts on the scotch yoke 70. Consequently, the scotch yoke 70 moves with respect to the connecting shaft 62 by a size of the gap 80. The connecting shaft 62 may collide with the rolling bush 74 in the shaft hole 74*a*, and thus abnormal noise may be generated.

The direction of the force is reversed upside down, but the same phenomenon may occur at the exhaust start timing T2. When the exhaust step A2 starts, a transient differential pressure acts on the displacer assembly 18 in the expander 14, and this force acts upward on the scotch yoke 70, and the scotch yoke 70 moves with respect to the connecting shaft 62 by the size of the gap 80. The connecting shaft 62 may collide with the rolling bush 74 in the shaft hole 74*a*, and thus abnormal noise may be generated.

However, since the cryocooler 10 is usually installed with the low temperature side facing downward, the influence of the upward force acting on the scotch yoke 70 is alleviated by the gravity (that is, the downward force) acting on the displacer assembly 18. Therefore, the abnormal noise may be louder at the intake start timing T1 than at the exhaust start timing T2.

As described above, during the operation of the cryocooler 10, especially when the intake and exhaust of the working gas are switched, the direction of the gas pressure acting on the motion conversion mechanism 43 is reversed, and thus abnormal noise may be generated from the motion conversion mechanism 43. Abnormal noise may also be generated when the motion direction of the motion conversion mechanism 43 is reversed. As the abrasion progresses, the gap 80 also becomes larger, and abnormal noise may become noticeable. In the typical operation of the cryocooler 10, the intake start timing T1 is as high as once per second. Such frequent occurrence of abnormal noise may be offensive to cryocooler users. Even if the cryocooler 10 is operated in an unmanned environment, such frequent collision between the components may adversely affect the life of the motion conversion mechanism 43.

A method of estimating the progress of abrasion on the basis of the cumulative operation time of the cryocooler 10 is not very practical because the progress of abrasion differs depending on individual cryocoolers, as described at the beginning of the present specification.

A typical cryocooler may be provided with an ammeter that measures a motor current in order to detect an abnormal increase in the motor current that may occur when an abnormally large load is applied to the motor. However, since the expansion of the gap 80 due to abrasion does not increase a load on the motor 42, the abrasion of the motion conversion mechanism 43 cannot be effectively detected even by this method.

Figure 7:
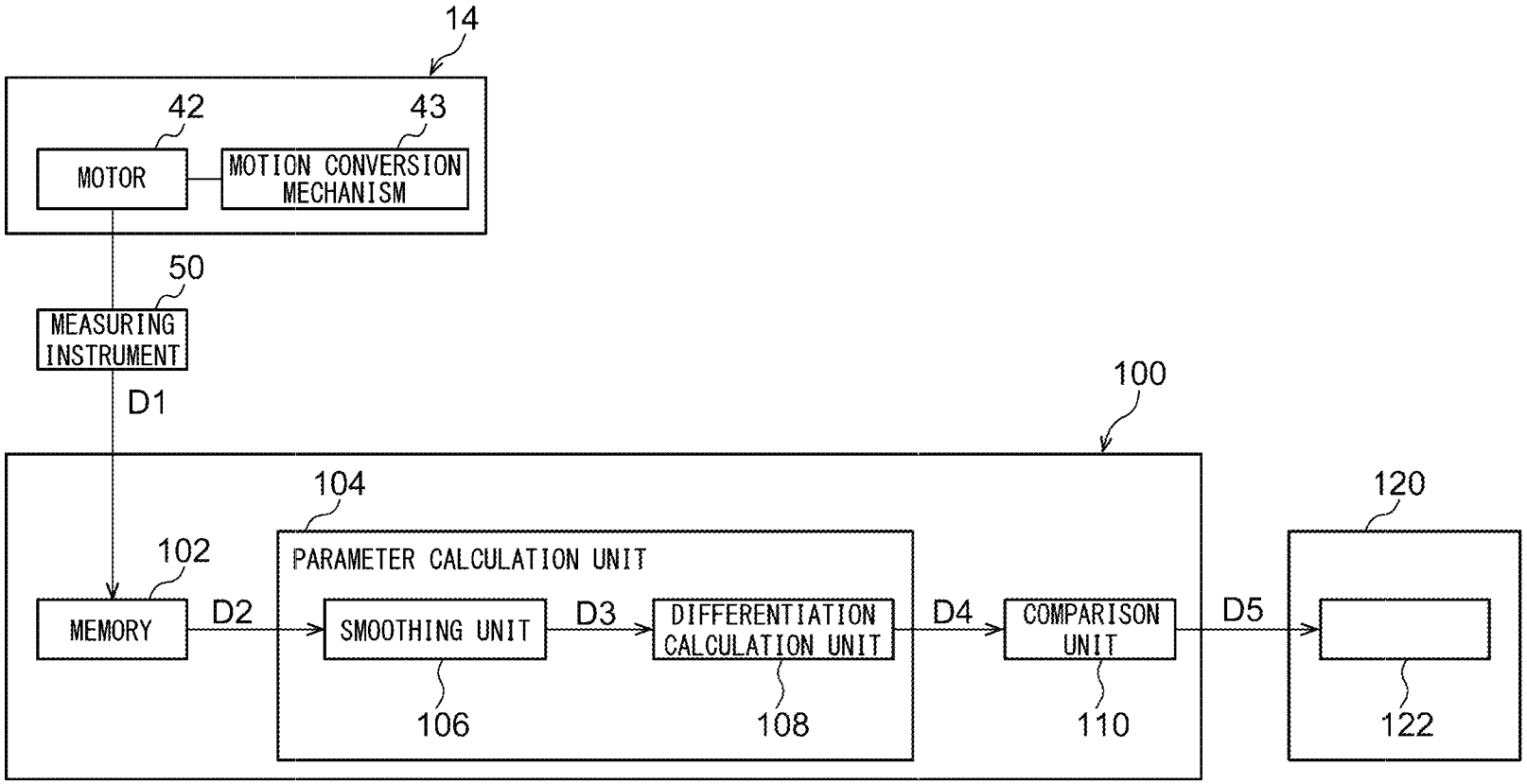
FIG. 7 is a block diagram of a diagnosis device according to the embodiment.

FIG. 7 is a block diagram of a diagnosis device according to the embodiment. The diagnosis device of the motion conversion mechanism 43 includes the motor 42, the measuring instrument 50, and the processing unit 100. The processing unit 100 includes a memory 102, a parameter calculation unit 104, and a comparison unit 110. The diagnosis device may include notification means 120 for providing a visual notification of information indicating a diagnosis result, and the notification means 120 may include, for example, a display 122. The notification means 120 may provide a notification of a diagnosis result by voice such as using a speaker. The notification means 120 may transmit a diagnosis result to a remote device via a network such as the Internet.

The processing unit 100 detects abrasion of a sliding surface between a first component and a second component of the motion conversion mechanism 43 on the basis of section data D2 including the intake start timing T1 or the exhaust start timing T2 in the time-series data D1. In the present embodiment, the processing unit 100 detects abrasion of the sliding surface of the motion conversion mechanism 43 on the basis of the section data D2 over at least one cycle of the linear reciprocating motion of the displacer in the time-series data D1. The first component and the second component are, for example, the connecting shaft 62 and the rolling bush 74. The processing unit 100 calculates a sliding surface abrasion parameter D4 on the basis of the section data D2, and detects the abrasion of the sliding surface on the basis of comparison between the sliding surface abrasion parameter D4 and a parameter threshold value.

The measuring instrument 50 outputs the time-series data D1 indicating power consumption of the motor 42 or a current flowing through the motor 42 to the memory 102. The memory 102 stores the time-series data D1. In addition to the time-series data D1, the memory 102 may store or preserve in advance various pieces of output data intermediately or finally generated or output by the processing unit 100, or data related to the cryocooler 10.

The parameter calculation unit 104 reads the section data D2 from the memory 102 and calculates the sliding surface abrasion parameter D4 on the basis of the section data D2. As described above, the section data D2 corresponds to data measured for a time corresponding to one cycle (typically, for example, about 1 second) of the linear reciprocating motion (that is, the refrigeration cycle) of the displacer in the time-series data D1. In a case where the intake start timing T1 (or the exhaust start timing T2) can be specified in the time-series data D1, the data measured for a predetermined time including the intake start timing T1 (or the exhaust start timing T2) in the time-series data D1 may be used as the section data D2.

In a case where the time-series data D1 indicates the power consumption of the motor 42, the parameter calculation unit 104 may calculate the sliding surface abrasion parameter D4 by performing a smoothing process and time differentiation on the section data D2. Therefore, the parameter calculation unit 104 may include a smoothing unit 106 and a differentiation calculation unit 108. The smoothing unit 106 performs a smoothing process on the section data D2 to generate smoothed section data D3. The differentiation calculation unit 108 performs time differentiation (for example, primary differentiation) on the smoothed section data D3 to calculate the sliding surface abrasion parameter D4.

The smoothing process may include a process of taking a moving average of the section data D2 in a time frame based on a cycle of a power supply frequency (for example, 50 Hz or 60 Hz) of the motor 42. Therefore, the smoothing unit 106 takes a moving average of the section data D2 for a time length of, for example, one cycle (or an integer multiple thereof) of the power supply frequency of the motor 42, and generates the smoothed section data D3. Consequently, a ripple corresponding to the power supply frequency of the motor 42 included in the section data D2 can be effectively removed. The smoothing unit 106 may include other suitable smoothing filter that remove noise.

The time differentiation means a process of differentiating waveform data input to the differentiation calculation unit 108 with respect to time or a variable corresponding to time. The variable corresponding to time may be, for example, an operation angle of the cryocooler 10. The operation angle is perfectly associated with time. For example, as described with reference to FIG. 3, one refrigeration cycle of the cryocooler 10 is associated with an operation angle of 360 degrees.

The time-series data D1, that is, the section data D2 is often discrete data. In that case, the differentiation calculation unit 108 performs a differential process on the smoothed section data D3 and calculates the sliding surface abrasion parameter D4. For example, a time differentiation $\Delta P_{ave}/\Delta t$ of the moving average $P_{ave}$ of the power consumption of the motor 42 is calculated according to $\Delta P_{ave}/\Delta t=(P_{ave}(t)-P_{ave}$ (t'))/(t−t') when a measured value of the power consumption at the measurement time t is set to $P_{ave}(t)$ and a measured value of the power consumption at the next measurement time t is set to $P_{ave}(t')$. A value of the time differentiation $\Delta P_{ave}/\Delta t$ obtained as described above is used as the sliding surface abrasion parameter D4. An absolute value $|\Delta P_{ave}/\Delta t|$ of the time differentiation may be used as the sliding surface abrasion parameter D4.

In a case where the time-series data D1 indicates the current flowing through the motor 42, the parameter calculation unit 104 may calculate the sliding surface abrasion parameter D4 by performing a smoothing process on the section data D2. The smoothing unit 106 performs a smoothing process on the section data D2, and outputs the smoothed section data D3 as the sliding surface abrasion parameter D4. The processing unit 100 does not have to include the differentiation calculation unit 108.

In this case, only one phase of the measured three-phase currents may be used as the section data D2. Alternatively, two-phase or three-phase currents may be used as the section data D2. The smoothing unit 106 performs a smoothing process on each of the two-phase or three-phase currents, and may output one of the smoothed two-phase or three-phase currents, or a maximum value or an average value thereof as the sliding surface abrasion parameter D4.

The comparison unit 110 generates abrasion diagnosis data D5 on the basis of comparison between the sliding surface abrasion parameter D4 and the parameter threshold value. The abrasion diagnosis data D5 indicates whether or not abrasion is detected on the sliding surface between the first component and the second component of the motion conversion mechanism 43. The parameter threshold value is preset and stored in the memory 102. The parameter threshold value may be set as appropriate on the basis of empirical knowledge of a designer, experiments or simulations by the designer, or the like.

The abrasion diagnosis data D5 is sent to the notification means 120, and a user is notified of a diagnosis result by displaying the diagnosis result, for example, on the display 122. In a case where abrasion is detected, the notification means 120 may notify a user with an alarm sound. Instead of (or with) providing an immediate notification as described above, the abrasion diagnosis data D5 may be stored in the memory 102 such that the data can be presented to the user as necessary.

An internal configuration of the processing unit 100 is realized by an element or a circuit including a CPU and a memory of a computer as a hardware configuration and is realized by a computer program as a software configuration, but is shown in FIG. 1 as a functional block realized in cooperation therebetween. It is clear for those skilled in the art that such a functional block can be realized in various manners through combination between hardware and software.

For example, the processing unit 100 can be implemented by combining a processor (hardware) such as a central processing unit (CPU) or a microcomputer and a software program executed by the processor (hardware). Such a hardware processor may be configured by a programmable logic device such as a field programmable gate array (FPGA), or may be a control circuit such as a programmable logic controller (PLC). The software program may be a computer program causing the processing unit 100 to perform diagnosis on the cryocooler 10.

Figure 8:
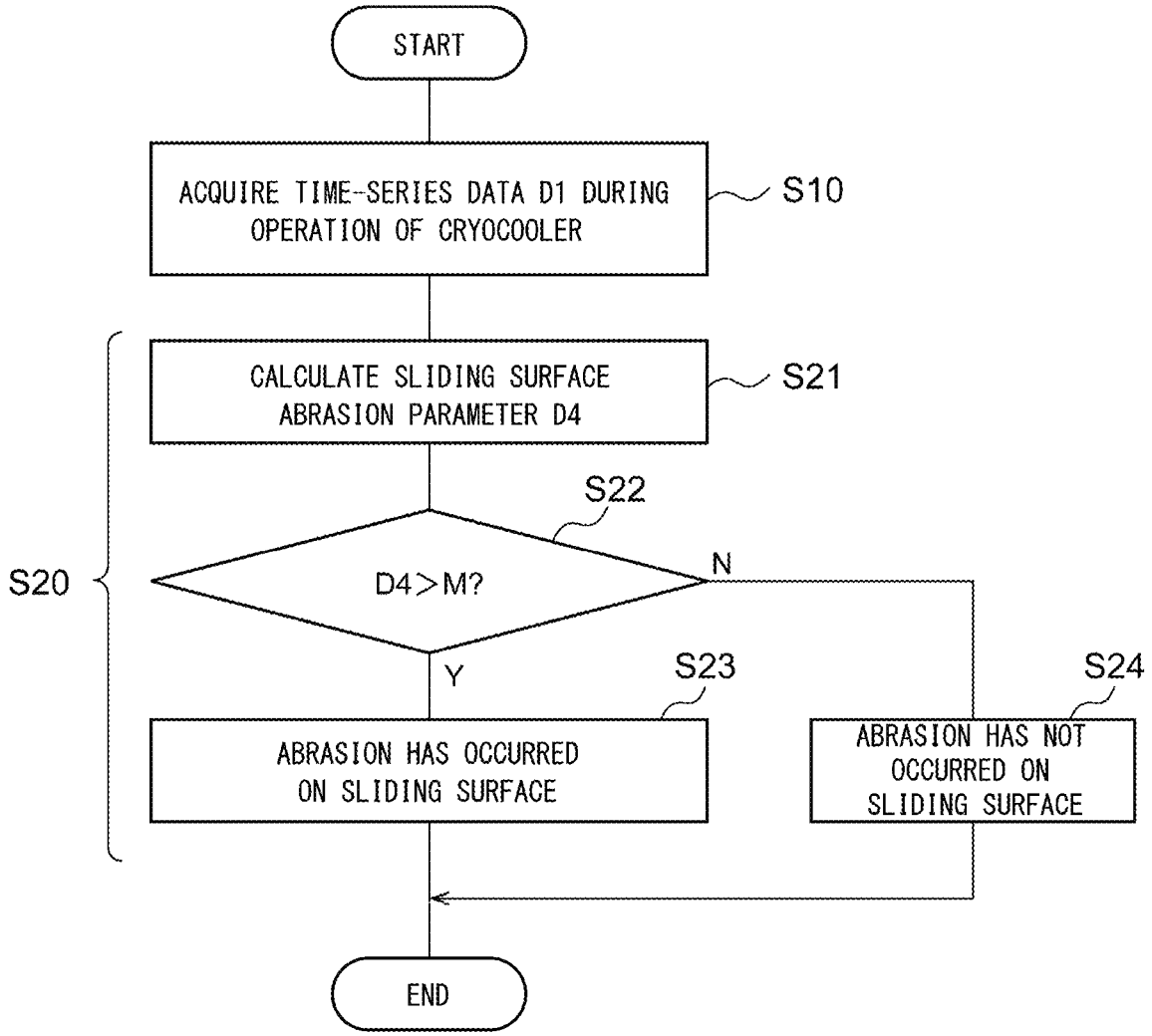
FIG. 8 is a flowchart showing a diagnosis method of the cryocooler according to the embodiment.

FIG. 8 is a flowchart showing a diagnosis method of the cryocooler 10 according to the embodiment. First, as shown in FIG. 8, during the operation of the cryocooler 10, the time-series data D1 indicating power consumption of the motor 42 or a current flowing through the motor is acquired (S10). Then, abrasion of the sliding surface between the first component and the second component of the motion conversion mechanism 43 is detected on the basis of the section data D2 (S20).

In S20, the sliding surface abrasion parameter D4 is calculated on the basis of the section data D2 (S21). The calculated sliding surface abrasion parameter D4 is compared with the parameter threshold value M (S22). In a case where the sliding surface abrasion parameter D4 exceeds the parameter threshold value M (Y in S22), the comparison unit 110 determines that abrasion has occurred on the sliding surface (S23), and outputs the abrasion diagnosis data D5 indicating that fact. In a case where the sliding surface abrasion parameter D4 is equal to or less than the parameter threshold value M (N in S22), the comparison unit 110 determines that no abrasion has occurred on the sliding surface (S24), and outputs the abrasion diagnosis data D5 indicating that fact. In this way, the diagnosis process ends.

The processing unit 100 periodically and repeatedly executes such a diagnosis process. Since abrasion of the sliding surface of the motion conversion mechanism 43 is a long-term phenomenon that gradually progresses over a long span, the diagnosis process is practically sufficient when the diagnosis method is performed occasionally during the operation of the cryocooler 10. Alternatively, the diagnosis process may be performed at all times during the operation of the cryocooler 10.

In order to avoid misdiagnosis due to noise, the comparison unit 110 may determine that abrasion has occurred on the sliding surface in a case where the sliding surface sliding surface abrasion parameter D4 exceeds the parameter threshold value M continuously for a certain period of time, determine that no abrasion has occurred on the sliding surface is not abrasion in other cases. The comparison unit 110 may calculate the maximum value of the sliding surface abrasion parameter D4 for a plurality of pieces of (for example, 10 or more or 100 or more) section data D2, and in a case where all of these values exceed the threshold value, determine that abrasion has occurred on the sliding surface. The plurality of pieces of section data D2 may be acquired at different timings, and may be acquired, for example, during a plurality of consecutive reciprocating motions of the displacer. Each piece of section data D2 includes the intake start timing T1 (or the exhaust start timing T2).

FIGS. 9A to 9F are diagrams showing waveform data obtained when the time-series data D1 indicating the power consumption of the motor 42 is input to the processing unit 100 according to the embodiment. The signal waveform shown in each figure is based on the power consumption of the motor 42 for one cycle (that is, 360 degrees) measured by the measuring instrument 50. The intake start timing T1 is set to about 300 degrees, and the exhaust start timing T2 is set to about 120 degrees.

Figure 9A:
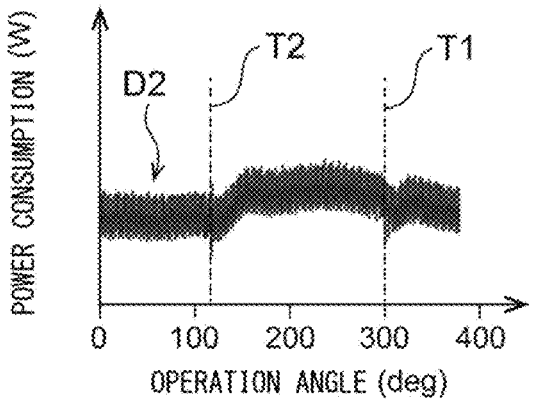
FIGS. 9A to 9F are diagrams showing waveform data obtained when time-series data indicating power consumption of a motor is input to a processing unit according to the embodiment.
Figure 9B:
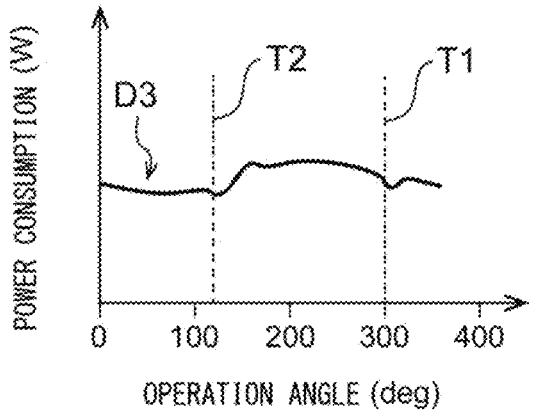
Figure 9C:
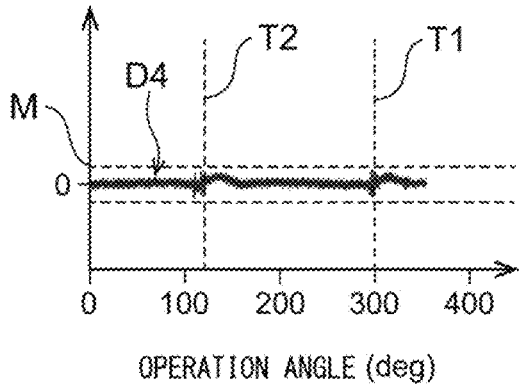

FIGS. 9A, 9B, and 9C show the section data D2, the smoothed section data D3, and the sliding surface abrasion parameter D4, respectively. These signal waveforms are obtained by performing a diagnosis process on the cryocooler 10 that operates normally (that is, there is no abrasion in the motion conversion mechanism 43 and there is no unnecessary backlash between the connecting shaft 62 and the rolling bush 74).

From the time-series data D1, the section data D2 for one refrigeration cycle of the cryocooler 10 is acquired. As shown in FIG. 9A, the section data D2 vibrates finely because a ripple corresponding to the power supply frequency occurs. The ripple is removed through a smoothing process, and as shown in FIG. 9B, the smoothed section data D3 is obtained. The section data D3 is smoothed by taking a moving average of the section data D2 with a time length of one cycle of the power supply frequency of the motor 42. The smoothed section data D3 indicates fluctuations in power consumption according to an operating state such as a load of the motor 42. By performing time differentiation on the smoothed section data D3, the sliding surface abrasion parameter D4 shown in FIG. 9C is obtained.

It can be seen that the sliding surface abrasion parameter D4 has a substantially constant value near zero in the normal (sufficiently small degree of abrasion) cryocooler 10. In this case, the sliding surface abrasion parameter D4 does not exceed the parameter threshold value M.

Figure 9D:
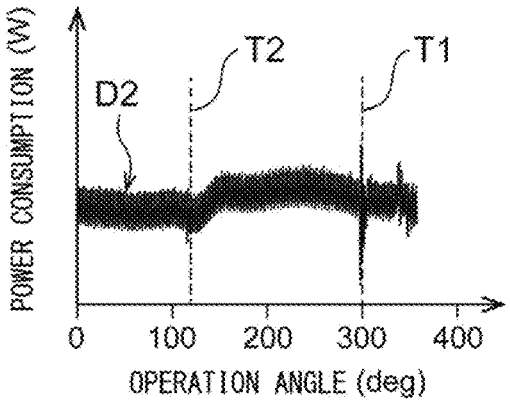
Figure 9E:
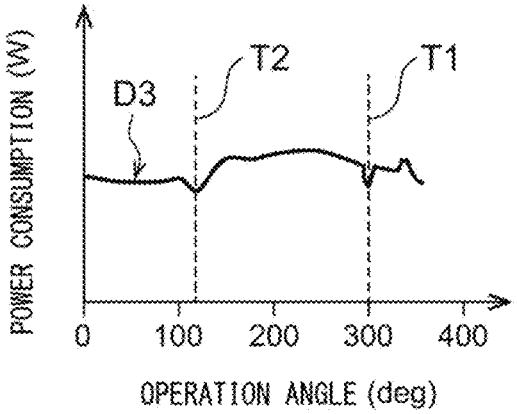
Figure 9F:
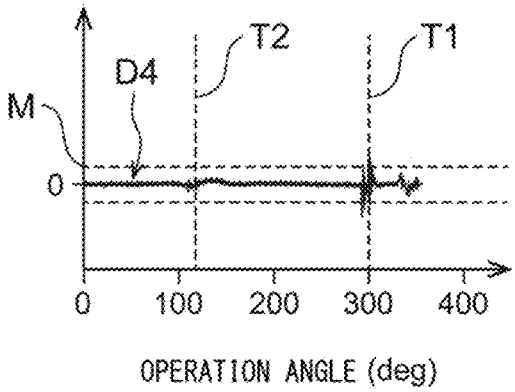

FIGS. 9D, 9E, and 9F show the section data D2, the smoothed section data D3, and the sliding surface abrasion parameter D4, respectively. However, these are obtained by performing a diagnosis process on the cryocooler 10 in which abrasion of the sliding surface of the motion conversion mechanism 43 has already progressed. In the cryocooler 10, a certain amount of abnormal noise is generated due to backlash between the connecting shaft 62 and the rolling bush 74 during operation.

In the same manner as in the normal cryocooler 10, the section data D2 shown in FIG. 9D is oscillating, and is subjected to a smoothing process such that the smoothed section data D3 is obtained as shown in FIG. 9E. By performing time differentiation on the smoothed section data D3, the sliding surface abrasion parameter D4 shown in FIG. 9F is obtained.

As shown in FIG. 9F, in the period other than the intake start timing T1, the sliding surface abrasion parameter D4 has a substantially constant value near zero, as in the normal case. However, the sliding surface abrasion parameter D4 remarkably fluctuates at the intake start timing T1 and exceeds the parameter threshold value M. It is considered that this large fluctuation is caused by switching between intake and exhaust of the working gas in the cryocooler 10 and the backlash between the components of the motion conversion mechanism 43. Therefore, it is possible to detect abrasion of the sliding surface of the motion conversion mechanism 43 on the basis of the sliding surface abrasion parameter D4 at the intake start timing T1.

Figure 10:
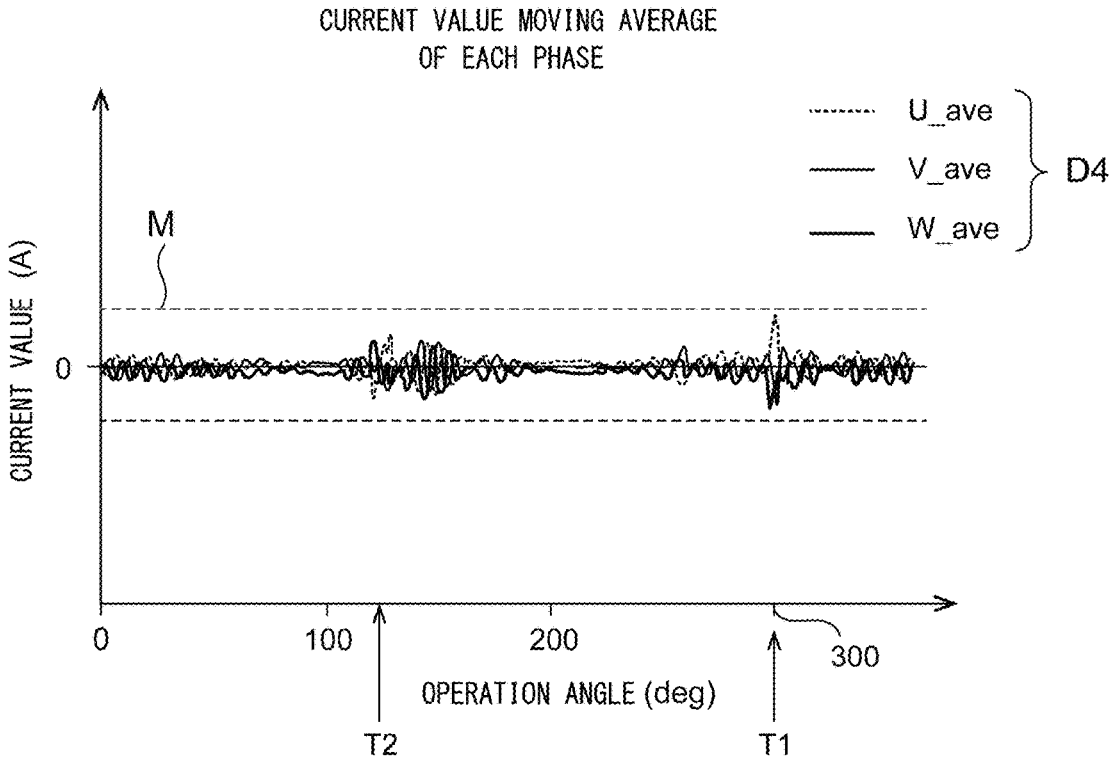
FIG. 10 is a diagram showing waveform data obtained when time-series data indicating a current flowing through the motor is input to the processing unit according to the embodiment.
Figure 11:
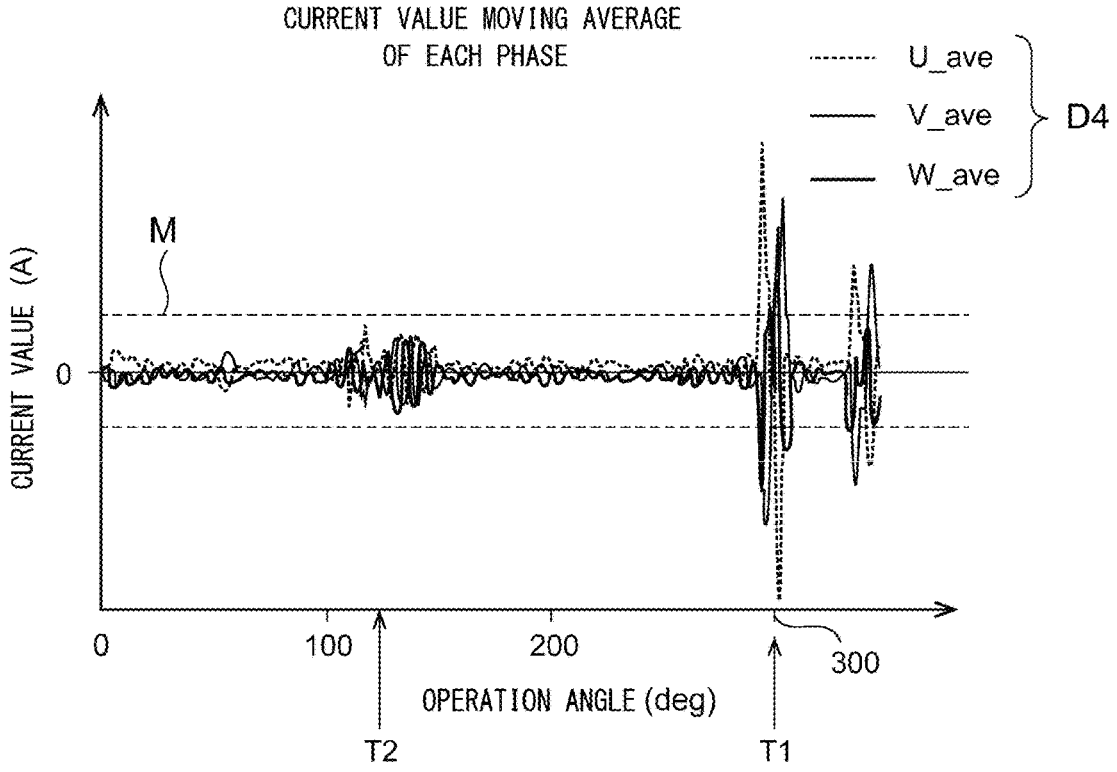
FIG. 11 is a diagram showing waveform data obtained when time-series data indicating a current flowing through the motor is input to the processing unit according to an embodiment.

FIGS. 10 and 11 are diagrams showing waveform data obtained when time-series data D1 indicating a current flowing through the motor 42 is input to the processing unit according to the embodiment. FIG. 10 shows the sliding surface abrasion parameter D4 for the normal cryocooler 10, and FIG. 11 shows the sliding surface abrasion parameter D4 for the cryocooler 10 in which abrasion has progressed.

From the time-series data D1 of three-phase currents (a U-phase, a V-phase, and a W-phase) of the motor 42 measured by the measuring instrument 50, the section data D2 for one refrigeration cycle of the cryocooler 10 is acquired. The section data D2 is smoothed, for example, by taking a moving average for the time length of one cycle of the power supply frequency of the motor 42. The smoothed section data D3 is used as the sliding surface abrasion parameter D4.

As shown in FIG. 10, the sliding surface abrasion parameter D4 is near zero in the normal cryocooler 10. The sliding surface abrasion parameter D4 does not exceed the parameter threshold value M.

On the other hand, as shown in FIG. 11, in a case where abrasion has occurred on the sliding surface of the motion conversion mechanism 43, the sliding surface abrasion parameter D4 remarkably fluctuates at the intake start timing T1 and exceeds the parameter threshold value M. In the period other than the intake start timing T1, the sliding surface abrasion parameter D4 remains near zero in the same manner as in the normal case. Therefore, it is possible to detect abrasion of the sliding surface of the motion conversion mechanism 43 on the basis of the sliding surface abrasion parameter D4 at the intake start timing T1.

As described above, according to the embodiment, the cryocooler 10 can measure power consumption of the motor 42 or a current flowing through the motor 42 at the intake start timing T1, and detect abrasion of the motion conversion mechanism 43 on the basis of the measurement result.

As described above, even at the exhaust start timing T2, the pressure of the working gas may act on the backlash between the components existing in the motion conversion mechanism 43. Therefore, depending on the specifications and operation conditions of the cryocooler 10, it is possible to detect abrasion of the motion conversion mechanism 43 on the basis of a measurement result at the exhaust start timing T2.

In a case where the progress of abrasion of the sliding components is left unattended, the cryocooler 10 may eventually fail. In a case where the cryocooler 10 fails, an operation of a cryogenic system (for example, a superconductivity equipment or an MRI system) that uses the cryocooler 10 is required to be stopped until maintenance such as repair of the cryocooler or replacement with a new one is completed. In the case of a sudden failure, the time required for recovery tends to be relatively long.

However, according to the embodiment, it is possible to diagnose the sliding components of the cryocooler 10 and notify a user of the cryocooler 10 or a service person who performs maintenance of the cryocooler 10 of a diagnosis result. It is possible to take measures to minimize the impact on an operation of the cryogenic system on the basis of the diagnosis result.

The sliding surface abrasion parameter D4 shown in FIGS. 9F and 11 indicates the experimental results for the cryocooler 10 in which abnormal noise has been actually generated. However, it is assumed that the sliding surface abrasion parameter D4 will fluctuate in the same manner as the abrasion progresses, even before abnormal noise is generated. Therefore, according to the embodiment, it is expected that abrasion can be detected before abnormal noise is generated. By performing maintenance of the cryocooler 10 at that time, abnormal noise can be prevented.

In the embodiment, it is not intended to diagnose a failure of the motor 42 itself. According to the embodiment, it is possible to diagnose the components of the motion conversion mechanism 43 instead of the motor 42 by using the motor 42 and the measuring instrument 50 that monitors an operation of the motor 42.

The motor 42 of the cryocooler 10 is often provided with a sensor that measures power consumption of the motor 42 or a current flowing through the motor 42, like the measuring instrument 50. Therefore, the embodiment is also advantageous in that the motion conversion mechanism 43 can be diagnosed without adding a new sensor to the cryocooler 10.

According to the embodiment, the diagnosis process is performed on the basis of the section data D2 over at least one cycle of the linear reciprocating motion of the displacer in the time-series data D1. In the above-described way, it is not necessary to specify the intake start timing T1 (or the exhaust start timing T2) when the measuring instrument 50 performs measurement (or when the section data D2 is generated). In order to detect these intake/exhaust switching timings (T1 and T2), a timing detection sensor such as a working gas pressure sensor in the cryocooler cylinder 16 may be required, but the embodiment is advantageous in that such a timing detection sensor does not have to be newly provided in the cryocooler 10. The cryocooler 10 may be provided with a timing detection sensor.

In the above-described embodiment, a case where a rotation speed of the motor 42 is kept constant has been described, but a rotation speed of the motor 42 may be variable. Since power consumption or a current of the motor 42 may change when a motor rotation speed changes, the sliding surface abrasion parameter D4 may also change due to the influence thereof. This may cause an error in detecting abrasion of the motion conversion mechanism 43. Therefore, in order to reduce such an error, the processing unit 100 may monitor a rotation speed of the motor 42. For example, the processing unit 100 may start the above diagnosis process when a rotation speed of the motor 42 is kept constant. Alternatively, in a case where a rotation speed of the motor 42 is kept constant (for example, when a fluctuation of the rotation speed is less than a threshold value) during execution of the diagnosis process, the processing unit 100 may continue the diagnosis process and in a case where the rotation speed of the motor 42 fluctuates (for example, in a case where the rotation speed fluctuation is more than the threshold value), stop the diagnosis process.

Figure 12:
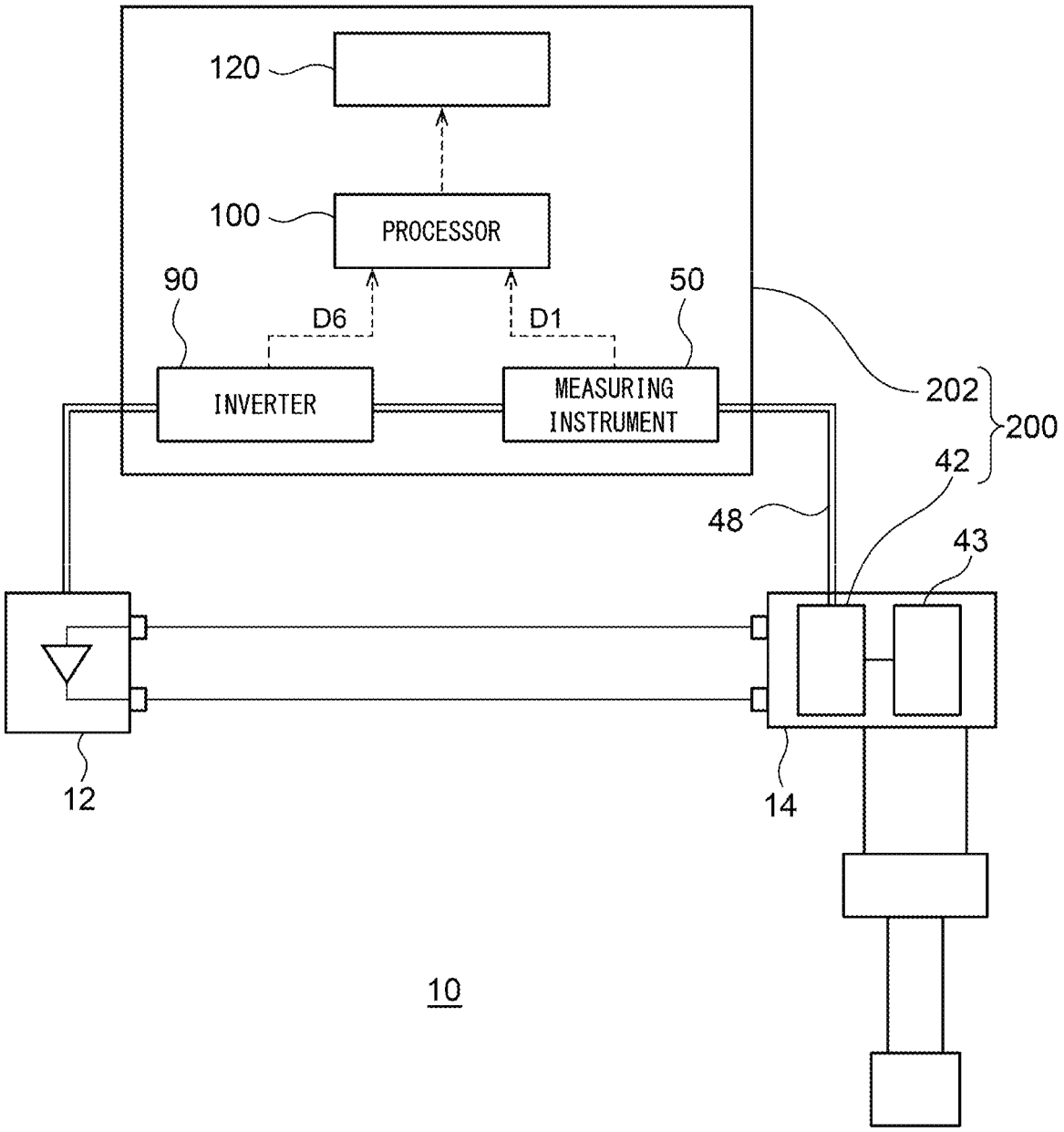
FIG. 12 is a block diagram of the diagnosis device according to an embodiment.

FIG. 12 is a block diagram of the diagnosis device according to the embodiment. In the present embodiment, a cryocooler 10 is different from the cryocooler 10 of the above embodiment with reference to FIGS. 1 to 11 in that an inverter 90 that controls a rotation speed of the motor 42 of the expander 14 is provided. The inverter 90 is installed on the power supply wiring 48 that connects the compressor 12 as a power source of the motor 42 to the motor 42. The motor 42 can operate at a rotation speed corresponding to an output frequency of the inverter 90 (also called an operation frequency of the cryocooler 10).

A diagnosis device 200 shown in FIG. 12 is configured as a diagnosis device of the motion conversion mechanism 43 as in the above-described embodiment, and includes the motor 42 and a diagnosis unit 202. The diagnosis unit 202 includes a measuring instrument 50 and a processing unit or a processor 100 together with the inverter 90. An internal configuration of the processing unit 100 may have the same configuration as, for example, that of the processing unit 100 shown in FIG. 7. The diagnosis unit 202 may include notification means 120 for providing a notification (for example, visual notification) of information indicating a diagnosis result.

The measuring instrument 50 is installed on the power supply wiring 48 between the inverter 90 and the motor 42, and is configured to output time-series data D1 indicating a current flowing through the motor 42 to the processing unit 100. For example, the measuring instrument 50 may be configured to individually and simultaneously measure three-phase currents output from the inverter 90 to the motor 42, and to output, for example, a voltage signal indicating a magnitude of each of the measured three-phase currents as the time-series data D1 to the processing unit 100.

The inverter 90 is configured to output, to the processing unit 100, output frequency information D6 indicating an output frequency of the inverter 90. For example, the output frequency of the inverter 90 may change in a range of 30 Hz to 100 Hz.

Alternatively, instead of the processing unit 100 receiving the output frequency information D6 from the inverter 90, the processing unit 100 may calculate the output frequency information D6 from the time-series data D1 input from the measuring instrument 50. For example, the processing unit 100 may calculate the output frequency of the inverter 90 by counting the number of current peaks per unit time from a waveform of a current flowing through the motor 42.

In order to reduce or prevent adverse effects on the motor 42 due to radio frequency noise that may be generated by the inverter 90, a noise suppression component such as a ferrite core may be provided on the power supply wiring 48 (for example, between the inverter 90 and the measuring instrument 50). In order to reduce or prevent adverse effects on the measuring instrument 50 due to radio frequency noise that may be generated by the inverter 90, a conductive shielding plate that surrounds at least a part of the inverter 90 may be provided in the diagnosis unit 202.

Figure 13:
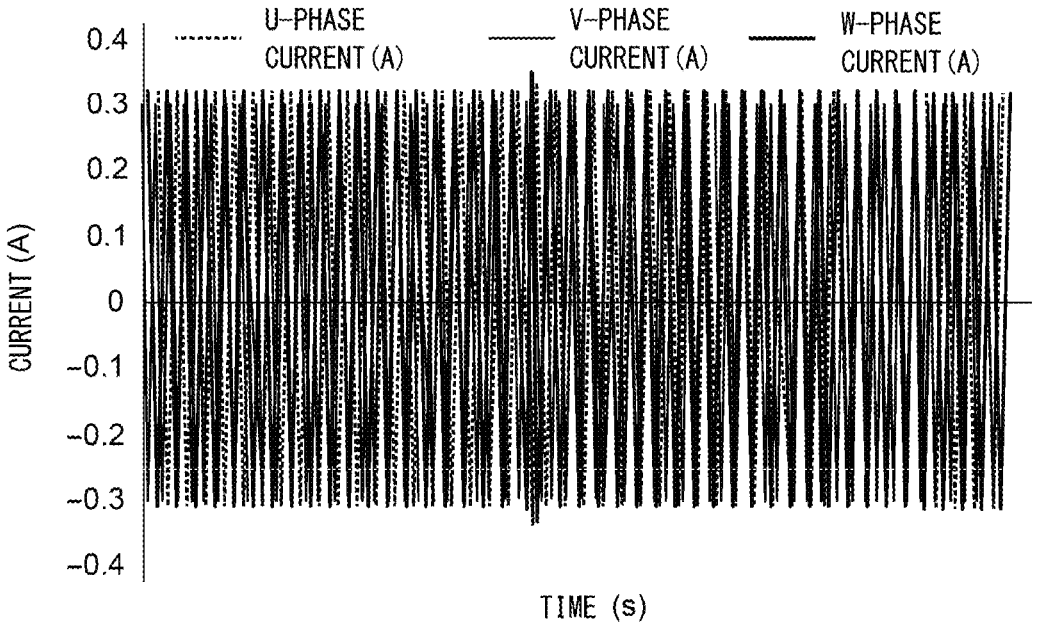
FIG. 13 is a diagram showing waveform data obtained when time-series data indicating a current flowing through the motor is input to the processing unit according to the embodiment.
Figure 14:
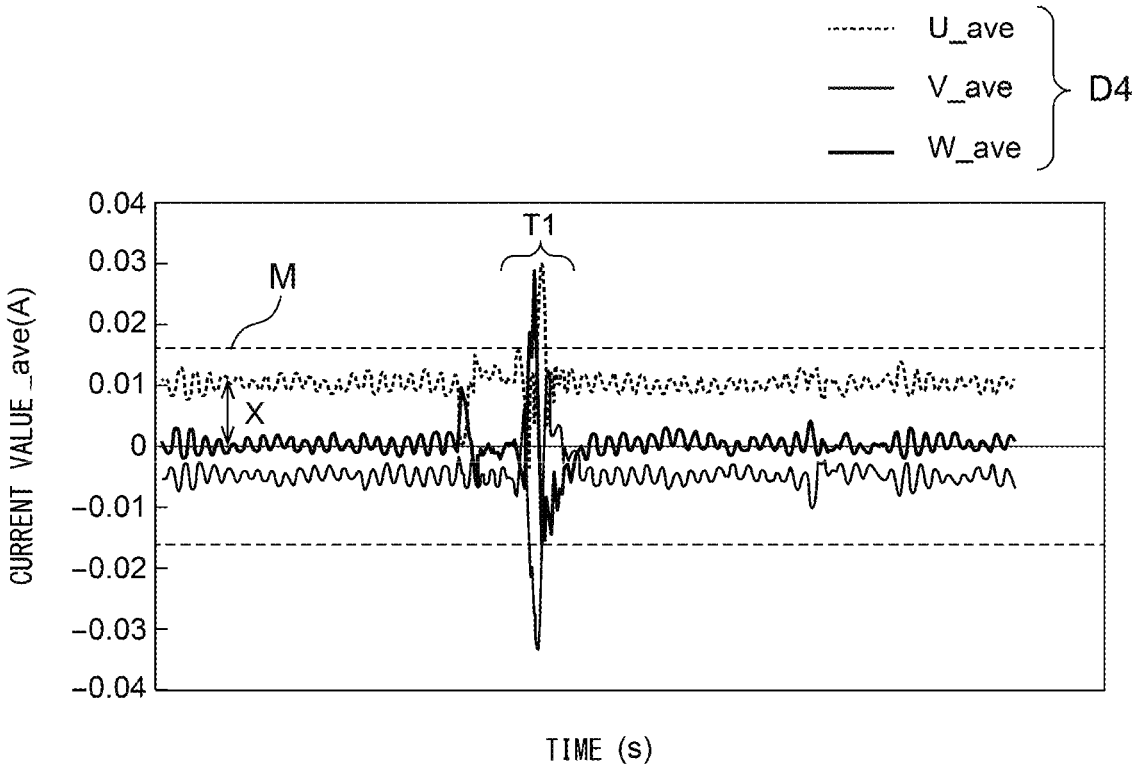
FIG. 14 is a diagram showing waveform data obtained when time-series data indicating a current flowing through the motor is input to the processing unit according to the embodiment.

An operation of the diagnosis device 200 shown in FIG. 12 will be described with reference to FIGS. 13 and 14. FIGS. 13 and 14 are diagrams showing waveform data obtained when the time-series data D1 indicating a current flowing through the motor 42 is input to the processing unit 100 according to the embodiment. FIGS. 13 and 14 show the section data D2 and the smoothed section data D3, respectively.

However, these data are obtained by performing a diagnosis process on the cryocooler 10 in which abrasion of the sliding surface of the motion conversion mechanism 43 has already progressed. In this cryocooler 10, a certain amount of abnormal noise is generated due to backlash between a first component and a second component (for example, the connecting shaft 62 and the rolling bush 74 shown in FIGS. 4 and 6) of the motion conversion mechanism 43.

From the time-series data D1 of three-phase currents (a U-phase, a V-phase, and a W-phase) of the motor 42 measured by the measuring instrument 50, the section data D2 for one refrigeration cycle of the cryocooler 10 is acquired. As shown in FIG. 13, the section data D2 is oscillating in the same manner as in the normal cryocooler 10. As an example, FIG. 13 shows three-phase real currents for one second when the output frequency of the inverter 90 is 60 Hz.

Here, the processing unit 100 may determine a length of the section data D2 on the basis of the output frequency information D6. As is known, the output frequency of the inverter 90 can be converted into a rotation speed of the motor 42, and one rotation of the motor 42 corresponds to one refrigeration cycle of the cryocooler 10. Therefore, the processing unit 100 may determine time for one refrigeration cycle from the output frequency information D6, and cut out the section data D2 measured for this time from the time-series data D1. In the above-described way, even in a case where the rotation speed of the motor 42 fluctuates, it is guaranteed that the section data D2 includes the intake start timing T1 or the exhaust start timing T2.

Alternatively, as an alternative, since the longest time required for one refrigeration cycle can be obtained in advance from the lowest output frequency of the inverter 90 (that is, the lowest possible rotation speed of the motor 42), the processing unit 100 may cut out the section data D2 measured for the longest time or longer from the time-series data D1 and may use this section data D2 to calculate the sliding surface abrasion parameter D4. In this case, a length of the section data D2 is fixed regardless of the output frequency of the inverter 90.

Next, the processing unit 100 takes a moving average of the section data D2 for a time length of, for example, one cycle (or an integer multiple thereof) of the output frequency of the inverter 90, and generates the smoothed section data D3. The smoothed section data D3 is used as the sliding surface abrasion parameter D4. An absolute value of the smoothed section data D3 may be used as the sliding surface abrasion parameter D4. The processing unit 100 may be provided with another suitable smoothing filter (for example, a low pass filter) for removing noise.

As shown in FIG. 14, in a case where abrasion has occurred on the sliding surface of the motion conversion mechanism 43, the sliding surface abrasion parameter D4 remarkably fluctuates at the intake start timing T1 and exceeds the parameter threshold value M. The sliding surface abrasion parameter D4 does not exceed the parameter threshold value M during a period other than the intake start timing T1. Considering that the numerical value on the vertical axis in FIG. 14 is 1/10 of that in FIG. 13, the sliding surface abrasion parameter D4 is considered to be substantially constant during the period other than the intake start timing T1. This is the same as a behavior of the sliding surface abrasion parameter D4 in the normal cryocooler 10. The parameter threshold value M may be set as appropriate on the basis of empirical knowledge of a designer, experiments or simulations by the designer, or the like in the same manner as in the above-described embodiment. Therefore, it is possible to detect abrasion of the sliding surface of the motion conversion mechanism 43 on the basis of the sliding surface abrasion parameter D4 at the intake start timing T1.

As described above, in the same manner as in the above-described embodiment, the processing unit 100 calculates the sliding surface abrasion parameter D4 on the basis of the section data D2 including the intake start timing T1 or the exhaust start timing T2 in the time-series data D1. In this case, the processing unit 100 calculates the sliding surface abrasion parameter D4 by performing a smoothing process on the section data D2. The smoothing process includes a process of taking a moving average of the section data D2 in a time frame based on a cycle of the output frequency of the inverter 90. The processing unit 100 detects abrasion of the sliding surface on the basis of comparison between the sliding surface abrasion parameter D4 and the parameter threshold value M. As described above, it is possible to detect abrasion of the sliding surface between the first component and the second component (for example, the connecting shaft 62 and the rolling bush 74 shown in FIGS. 4 and 6) of the motion conversion mechanism 43.

It can be seen that the sliding surface abrasion parameter D4 shown in FIG. 14 can have a steady deviation X (for example, U phase). Since a magnitude of the steady deviation X is not always known in advance, this can contribute to making it difficult to set the appropriate parameter threshold value M. Therefore, in order to reduce or eliminate this steady deviation X of the sliding surface abrasion parameter D4, the sliding surface abrasion parameter D4 may be acquired by subtracting a simple average of the section data D2 from the above moving average of the section data D2. Here, the simple average of the section data D2 refers to an average value of the section data D2 for a time (for example, a time corresponding to one refrigeration cycle) sufficiently longer than, for example, a time length of one cycle of the output frequency of the inverter 90. An absolute value of a difference between the moving average of the section data D2 and the simple average of the section data D2 may be used as the sliding surface abrasion parameter D4.

Figure 15:
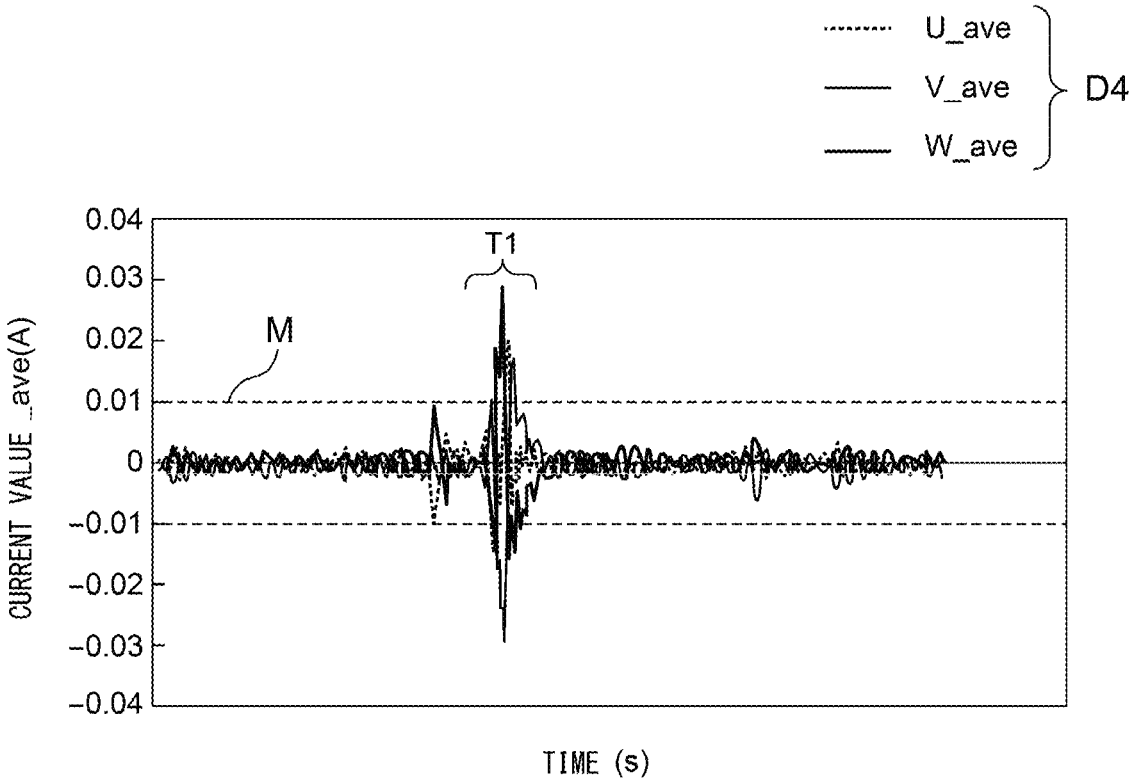
FIG. 15 is a diagram showing waveform data obtained when time-series data indicating a current flowing through the motor is input to the processing unit according to the embodiment.

FIG. 15 exemplifies the sliding surface abrasion parameter D4 obtained by a difference between the moving average of the section data D2 and the simple average of the section data D2. The sliding surface abrasion parameter D4 becomes a substantially constant value near zero in the period other than the intake start timing T1 as in the normal case, and does not exceed the parameter threshold value M. On the other hand, the sliding surface abrasion parameter D4 remarkably fluctuates at the intake start timing T1 and exceeds the parameter threshold value M. As shown in FIG. 15, since the steady deviation of the sliding surface abrasion parameter D4 is removed, the parameter threshold value M can be set to a smaller value, and thus abrasion can be detected with higher accuracy.

Figure 16:
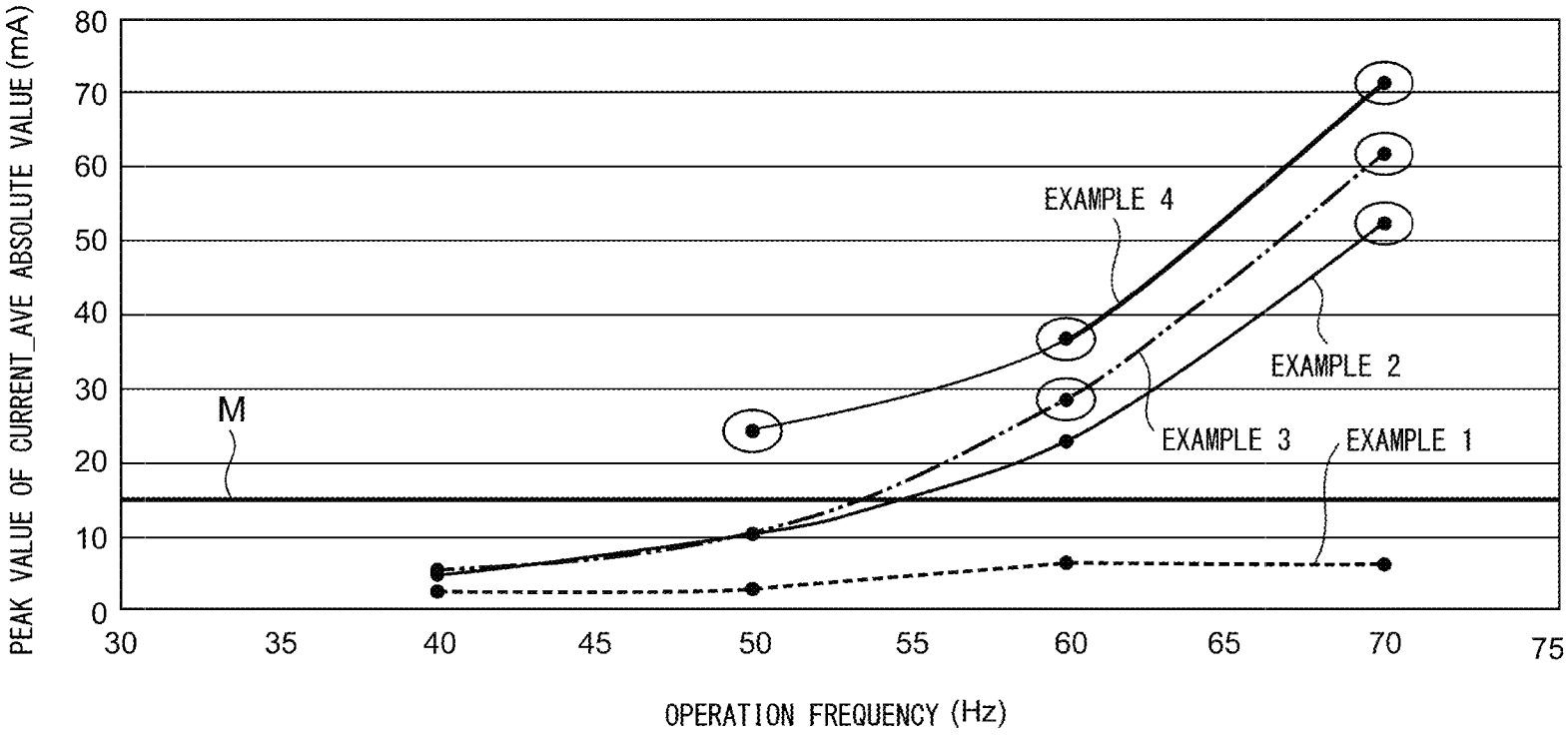
FIG. 16 is a graph plotting the maximum value of a sliding surface abrasion parameter for each of examples 1 to 4.

FIG. 16 is a graph in which the maximum value of the sliding surface abrasion parameter D4 is plotted for each of examples 1 to 4. The graph of the example 1 is obtained by performing a diagnosis process on a normal cryocooler (that is, the motion conversion mechanism 43 is abrasion-free or has sufficiently small abrasion and there is no unnecessary backlash between the connecting shaft 62 and the rolling bush 74). The examples 2 to 4 are obtained by performing a diagnosis process on a cryocooler in which abrasion of the sliding surface of the motion conversion mechanism 43 has already progressed. In the cryocoolers in the examples 2 to 4, a certain amount of abnormal noise is generated due to backlash between the connecting shaft 62 and the rolling bush 74 during operation. Abrasion progresses in the order of the example 2, the example 3, and the example 4, and when a size of the backlash (for example, the gap 80 shown in FIG. 6) in the cryocooler of the example 3 is 1, backlash sizes in the example 2 and the example 4 are 0.75 and 1.2, respectively.

In these examples, the sliding surface abrasion parameter D4 is acquired by taking the moving average of the current flowing through the motor 42 in a time frame based on the cycle of the output frequency of the inverter 90, as described with reference to FIGS. 12 to 15. In FIG. 16, peak values of the absolute value of the moving average of the current obtained as described above are plotted for a plurality of different output frequencies.

In the example 1 related to a normal cryocooler without abrasion, the maximum value of the sliding surface abrasion parameter D4 is almost constant regardless of the output frequency of the inverter 90, and is closest to zero. In the examples 2 to 4 in which abrasion is progressing, the maximum value of the sliding surface abrasion parameter D4 increases as the output frequency of the inverter 90 increases.

In FIG. 16, the circled plot represents an operation mode in which abnormal noise can be clearly heard. For example, in the example 2, the maximum value of the sliding surface abrasion parameter D4 exceeded about 50 mA at 70 Hz, and abnormal noise was heard at this time. In the example 3 in which abrasion was more progressing than in the example 2, abnormal noise was heard at both 60 Hz and 70 Hz. In the example 4 in which abrasion was even more progressing, abnormal noise was heard at 50 Hz, 60 Hz, and 70 Hz. As described above, as the abrasion progresses, abnormal noise is heard at a lower frequency, and the maximum value of the sliding surface abrasion parameter D4 also increases. In the example shown in FIG. 16, when the maximum value of the sliding surface abrasion parameter D4 exceeds about 25 mA, it can be seen that abnormal noise is heard.

According to the results shown in FIG. 16, when the maximum value of the sliding surface abrasion parameter D4 is in the range of, for example, about 10 to 25 mA, no clear abnormal noise is heard during the operation of the cryocooler, but it is considered that somewhat abrasion occurs in the motion conversion mechanism 43 compared with in the normal cryocooler of the example 1. Therefore, by setting the parameter threshold value M within this range, it is possible to detect abrasion before abnormal noise actually occurs. In this case, abnormal noise can be prevented by performing maintenance on the cryocooler 10.

The present invention has been described on the basis of the embodiments. It is clear for those skilled in the art that the present invention is not limited to the embodiments, various design changes are possible, various modification examples are possible, and such modification examples are also within the scope of the present invention. The various features described in relation to one embodiment are also applicable to other embodiments. New embodiments resulting from the combination have the effects of each of the combined embodiments.

In a certain embodiment, the cryocooler 10 may be a single-stage GM cryocooler, or another type of cryocooler with a motion conversion mechanism such as a scotch yoke mechanism.

In the above-described embodiments, the connecting shaft 62 and the rolling bush 74 are slidably connected to each other, but the connecting shaft 62 may be fixed to the rolling bush 74. In that case, since the motion conversion mechanism 43 has a sliding surface between the rolling bush 74 and the yoke plate 72, the processing unit 100 may detect abrasion of the sliding surface between the rolling bush 74 and the yoke plate 72 by using the same diagnosis process.

In one embodiment, the processing unit 100 may be a part of a cryogenic system (for example, a superconductivity equipment or an MRI system) provided with the cryocooler 10 instead of forming a part of the cryocooler 10.

The present invention has been described by using specific terms and phrases on the basis of the embodiments, but the embodiments show only one aspect of the principles and applications of the present invention, and various modifications and disposition changes are permitted in the embodiments within the scope without departing from the idea of the present invention defined in the claims.

The present invention can be used in the fields of cryocoolers, and diagnosis devices and diagnosis methods of cryocoolers.

It should be understood that the invention is not limited to the above-described embodiment, but may be modified into various forms on the basis of the spirit of the invention. Additionally, the modifications are included in the scope of the invention.

What is claimed is:

1. A cryocooler comprising:

a motor;

a displacer;

a cylinder that guides linear reciprocating motion of the displacer and forms an expansion chamber for a working gas between the cylinder and the displacer;

a pressure switching valve that determines an intake start timing of the working gas into the expansion chamber and an exhaust start timing of the working gas from the expansion chamber;

a motion conversion mechanism that converts rotating motion output by the motor into the linear reciprocating motion of the displacer, and includes a first component and a second component slidably connected to each other;

a measuring instrument that is connected to the motor to output time-series data indicating power consumption of the motor or a current flowing through the motor; and a processor configured to detect abrasion of a sliding surface between the first component and the second component of the motion conversion mechanism based on section data including the intake start timing or the exhaust start timing in the time-series data.

2. The cryocooler according to claim 1, wherein the processor is configured to detect the abrasion of the sliding surface of the motion conversion mechanism based on the section data over at least one cycle of the linear reciprocating motion of the displacer in the time-series data.

3. The cryocooler according to claim 1, wherein the first component includes a connecting shaft eccentrically connected to an output shaft of the motor, the second component includes a rolling element including a shaft hole formed therein, and the connecting shaft and the rolling element are slidably connected to each other via the sliding surface in the shaft hole.

4. The cryocooler according to claim 1, wherein the processor is configured to calculate a sliding surface abrasion parameter based on the section data, and to detect the abrasion of the sliding surface based on comparison between the sliding surface abrasion parameter and a parameter threshold value.

5. The cryocooler according to claim 4, wherein the measuring instrument outputs the time-series data indicating the power consumption of the motor to the processing unit, and the processor is configured to calculate the sliding surface abrasion parameter by performing a smoothing process and time differentiation on the section data.

6. The cryocooler according to claim 4, wherein the measuring instrument outputs the time-series data indicating the current flowing through the motor to the processor, and the processor is configured to calculate the sliding surface abrasion parameter by performing a smoothing process on the section data.

7. The cryocooler according to claim 5, wherein the smoothing process includes a process of taking a moving average of the section data in a time frame based on a cycle of a power supply frequency of the motor.

8. The cryocooler according to claim 4, further comprising:

an inverter that controls a rotation speed of the motor, wherein the measuring instrument outputs the time-series data indicating the current flowing through the motor to the processor, the processor is configured to calculate the sliding surface abrasion parameter by performing a smoothing process on the section data, and the smoothing process includes a process of taking a moving average of the section data in a time frame based on a cycle of an output frequency of the inverter.

9. A diagnosis device of a cryocooler, the cryocooler including a motion conversion mechanism that converts rotating motion output by a motor into linear reciprocating motion of a displacer and includes a first component and a second component slidably connected to each other, the diagnosis device comprising:

a measuring instrument that is connected to the motor to output time-series data indicating power consumption of the motor or a current flowing through the motor; and a processor configured to detect abrasion of a sliding surface between the first component and the second component of the motion conversion mechanism based on section data including an intake start timing of a working gas into an expansion chamber of the cryocooler or an exhaust start timing of the working gas from the expansion chamber in the time-series data.

10. A diagnosis method of a cryocooler, the cryocooler including a motion conversion mechanism that converts rotating motion output by a motor into linear reciprocating motion of a displacer and includes a first component and a second component slidably connected to each other, the diagnosis method comprising:

acquiring time-series data indicating power consumption of the motor or a current flowing through the motor; and detecting abrasion of a sliding surface between the first component and the second component of the motion conversion mechanism based on section data including an intake start timing of a working gas into an expansion chamber of the cryocooler or an exhaust start timing of the working gas from the expansion chamber in the time-series data.

* * * * *